US007806176B2

(12) United States Patent
Moody, V

(10) Patent No.: US 7,806,176 B2
(45) Date of Patent: Oct. 5, 2010

(54) WELL TUBULAR RUNNING TOOL

(76) Inventor: Braxton I. Moody, V, P.O. Box 52402, Lafayette, LA (US) 70505

( * ) Notice: Subject to any disclaimer, the term of this patent is extended or adjusted under 35 U.S.C. 154(b) by 329 days.

(21) Appl. No.: 11/787,890

(22) Filed: Apr. 17, 2007

(65) Prior Publication Data

US 2008/0257539 A1 Oct. 23, 2008

(51) Int. Cl.
*E21B 19/00* (2006.01)

(52) U.S. Cl. ..... 166/77.51; 166/85.1; 166/332.3; 166/334.2

(58) Field of Classification Search ..... 166/77.51, 166/85.1, 332.3, 334.2
See application file for complete search history.

(56) References Cited

U.S. PATENT DOCUMENTS

| | | | | |
|---|---|---|---|---|
| 4,535,852 | A * | 8/1985 | Boyadjieff et al. | 175/170 |
| 4,871,019 | A * | 10/1989 | Haley et al. | 166/167 |
| 5,682,952 | A | 11/1997 | Stokley | |
| 6,390,190 | B2 * | 5/2002 | Mullins | 166/90.1 |
| 6,742,584 | B1 | 6/2004 | Appleton | |
| 6,938,709 | B2 | 9/2005 | Juhasz et al. | |
| 7,004,259 | B2 | 2/2006 | Pietras | |
| 7,021,374 | B2 | 4/2006 | Pietras | |
| 7,036,202 | B2 | 5/2006 | Lorenz | |
| 7,096,977 | B2 | 8/2006 | Juhasz et al. | |
| 7,165,609 | B2 * | 1/2007 | Slack et al. | 166/77.1 |
| 2005/0000684 | A1 | 1/2005 | Slack et al. | |
| 2005/0252660 | A1 * | 11/2005 | Hughes et al. | 166/334.2 |
| 2006/0118293 | A1 | 6/2006 | Juhasz et al. | |
| 2006/0124293 | A1 | 6/2006 | Juhasz et al. | |
| 2006/0124305 | A1 | 6/2006 | Juhasz et al. | |
| 2006/0124353 | A1 | 6/2006 | Juhasz et al. | |
| 2009/0101332 | A1 * | 4/2009 | Shahin et al. | 166/77.51 |

* cited by examiner

*Primary Examiner*—Shane Bomar
(74) *Attorney, Agent, or Firm*—Charles S. Knobloch; Gordon T. Arnold; Arnold & Knobloch, L.L.P.

(57) ABSTRACT

A casing running tool comprising an integral elevation module and make-up/torque module. In accordance with one aspect or the invention, the tool is adapted to automatically engage a collared end of a tubular structure such as a casing string segment. The integral make-up/torque module is actuated by hydraulic control lines to exert compression force upon the outer diameter of a tubular, such as a casing string segment. This compression force is sufficient to enable torque to be applied to the tubular without slippage. In one embodiment, the make-up/torque module comprises an outer body carrying a plurality of hydraulically-actuable pistons, such that the tool is actuable from the rig floor to grasp the tubular with sufficient force that rotational force (torque) supplied via a drive motor in a top-drive rig. In accordance with another embodiment, the multifunction tool further includes an internal ball valve assembly for selectively allowing or restricting fluid flow through the tool. The elastic strength of biasing means on either end of the ball valve assembly takes into account possible over- or under hydraulic pressures which may exist within the tubulars already deployed.

34 Claims, 24 Drawing Sheets

WELL TUBULAR RUNNING TOOL

FIELD OF THE INVENTION

The present invention relates generally to the field of mechanical devices adapted for the manipulation and use of tubular structures, and in a particular embodiment relates to a device for handling and operation of tubular structures primarily used in hydrocarbon exploration and production.

BACKGROUND OF THE INVENTION

The use of so-called "top drives" in connection with the drilling of boreholes for the purposes of hydrocarbon exploration and production has become commonplace in the industry. In particular, "top drive" drilling operations are recognized by those of ordinary skill in the art as avoiding certain disadvantages of prior art drilling methods. Most notably, "top drive" drilling rigs can avoid the laborious and inefficient use of a "stabber," a manually controlled apparatus for threadably coupling the downward end of a tubular segment with the upper end of a tubular string extending downwardly into a borehole.

In a typical embodiment, a top drive operation involves the use of a manipulator designed to engage a tubular segment and raise the segment up into a power-assist top-drive apparatus. Specifically, a top end of the tubular segment is engaged by the top drive. The bottom end of the tubular segment engaged by the top drive may then be brought into contact with the top of a tubular string extending into a borehole, and the tubular segment is then threadably rotated into engagement with the tubular string as it is rotated by the top drive.

FIG. 21 shows a typical drilling rig 10 incorporating a top drive drilling system. In particular, rig 10 comprises a frame 12 and a pair of rails 14 along which a top drive assembly generally designated 16 rides for vertical movement thereof. A typical top drive assembly 16 comprises a drive motor 18 and a top drive output shaft 20 extending downwardly from the drive motor 18. The rig defines a drill floor 22 having a central opening 24 through which tubular elements are inserted downwardly into a well hole 26.

Also shown in FIG. 21 is a tubular running apparatus 30 which is adapted to engage the upper end of a tubular segment 32 and to mechanically couple the upper end to the top drive output shaft 20 thereby permitting rotation of the tubular segment 32 under control of the top drive.

The arrangement depicted in FIG. 21 is exemplary of the majority of top-drive drilling systems presently known and used, and such systems are familiar to anyone of ordinary skill in the art. Many variations among particular implementations of top-drive drilling systems have been and will continue to be implemented, and those of ordinary skill in the art having the benefit of the present disclosure will readily comprehend how the present invention may be implemented and deployed in any particular top-drive drilling system.

SUMMARY OF THE INVENTION

In view of the foregoing, the present invention is directed to a system including a running tool for engaging, manipulating, and operating tubular structures. The invention is particularly well-suited to the elevation and making-up of tubulars employed in the exploration and production of hydrocarbons. Such "tubulars," as this term is used throughout this disclosure, include well casing tubulars, drill pipe, landing strings, slickpipe, and so on. It is to be understood, however, that the principals and innovations of the present invention may find applicability in a wide range of fields, notwithstanding its especially advantageous application in the field of hydrocarbon exploration and production, particularly in the elevation and make-up of such tubular structures as oil and gas well casing and drilling strings.

In one embodiment, the invention comprises a tubular running tool integrating both elevation and make-up functionality within a singular multi-purpose component. In an exemplary embodiment, a tubular running tool comprises a plurality of integrated modules, including an elevating/lifting module and a make-up/torque module. The modules are physically and operationally integrated into a structure having a generally elongate cylindrical form.

In one embodiment, certain operational capabilities of a tubular running tool are actuated by means of hydraulic inputs. Internal structures of the tool are operable in a plurality of modes which, in sequence can be utilized to perform an elevating/lifting operation to engage and manipulate tubular elements such as segments of oil well casing, slickpipe, and/or drillstring.

In an exemplary embodiment, a running tool is provided with a module for efficiently engaging and then lifting a tubular structure having a coupling or collar on at least one end thereof. The tool is adapted to have a tubular structure inserted into one end thereof, either by axial movement of the tool relative to the tubular and/or by axial movement of the tubular relative to the tool. An engaging collet integrated into the tool is adapted to engage the tubular's collar upon sufficient travel of the tubular into the tool.

In accordance with one embodiment of the invention, a further integrated module of the tool is responsive to hydraulic inputs to establish a firm grip on the body of an engaged tubular, such that rotational force (torque) can be imparted to the tubular, such as, for example, the rotational force of a top drive upon a segment of oil well casing.

One perceived benefit of the invention as presently conceived is the possible elimination for the need of human presence at an elevated and potentially perilous location during the course of well casing make-up. This is achieved at least in part by virtue of the hydraulically-actuable components of a device in accordance with the invention.

BRIEF DESCRIPTION OF THE DRAWINGS

The foregoing and other features and aspects of the present invention will be best appreciated by reference to a detailed description of the specific embodiments of the invention, when read in conjunction with the accompanying drawings, wherein.

DETAILED DESCRIPTION OF SPECIFIC EMBODIMENTS OF THE INVENTION

In the disclosure that follows, in the interest of clarity, not all features of actual implementations are described. It will of course be appreciated that in the development of any such actual implementation, as in any such project, numerous engineering and technical decisions must be made to achieve the developers' specific goals and subgoals (e.g., compliance with system and technical constraints), which will vary from one implementation to another. Moreover, attention will necessarily be paid to proper engineering practices for the environment in question. It will be appreciated that such a development effort might be complex and time-consuming, but would nevertheless be a routine undertaking for those of ordinary skill in the relevant fields.

Figure 1:
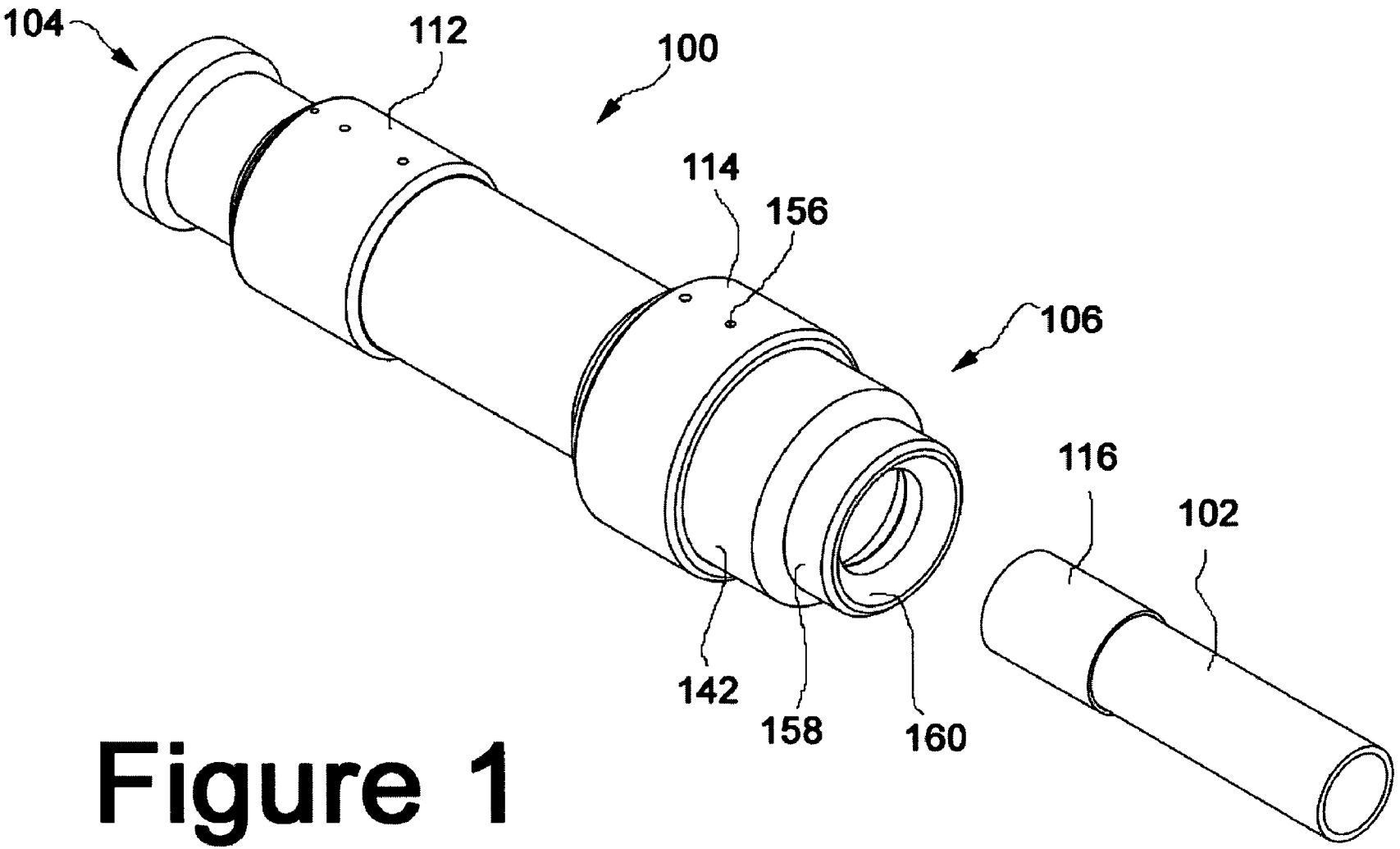
FIG. 1 is an isometric view of a running tool in accordance with one embodiment of the invention with a segment of casing proximate a bottom end thereof prior to insertion into the tool.
Figure 21:
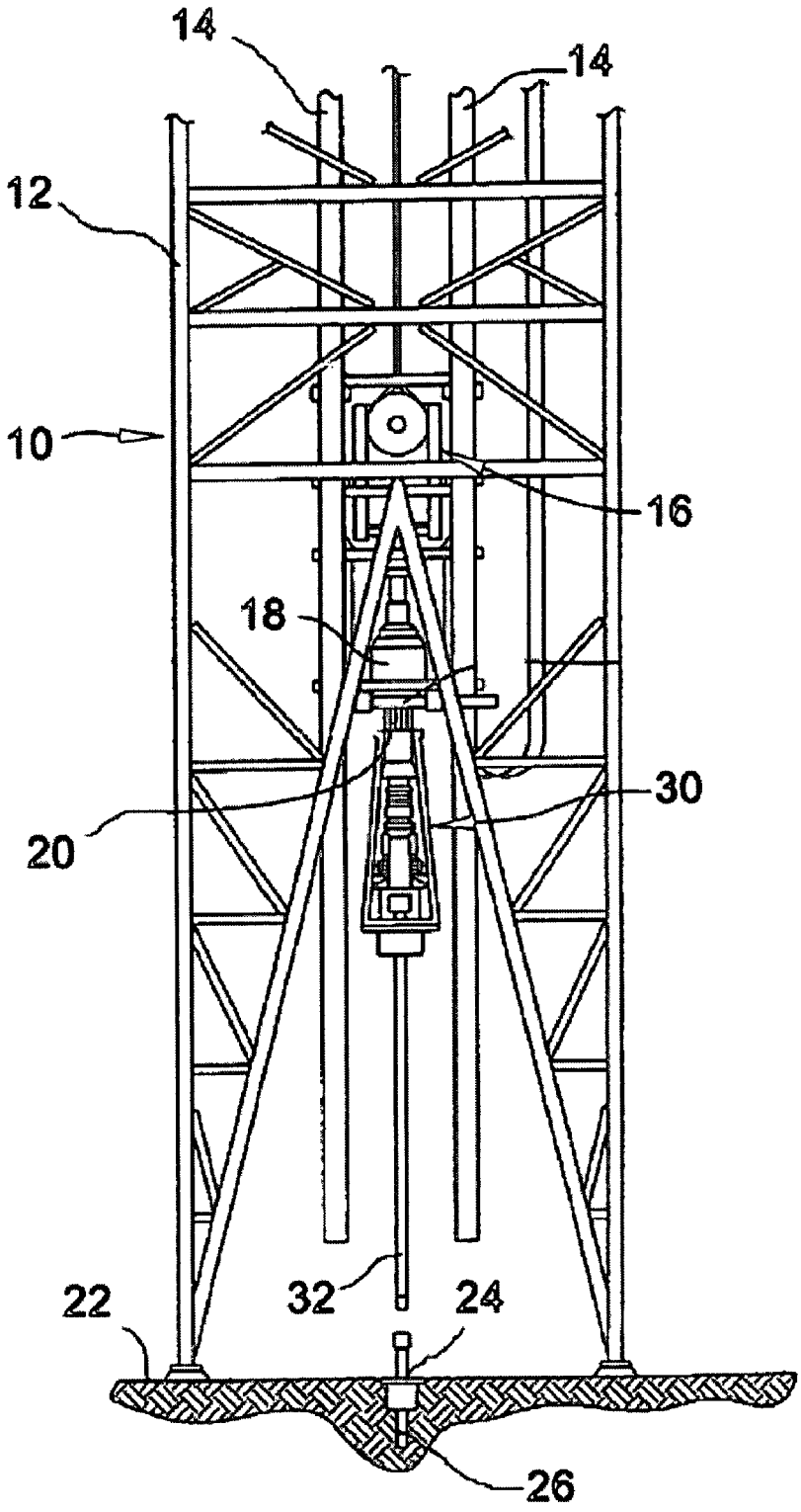
Figure 21 (Prior Art)
FIG. 21 is a side view of a top-drive drilling rig compatible with various embodiments of the invention and shown holding the embodiment of FIG. 1.

As previously noted, the present invention relates in an exemplary case to a running tool such as running tool 30 shown in FIG. 21 A running tool 100 in accordance with one embodiment of the invention is shown in the isometric view of FIG. 1. In the following description, running tool 100 will be described in the context of being utilized for assembly of drillstring casing, an upper portion 102 of a casing segment being shown in FIG. 1. It is to be understood, however, and will be appreciated by those of ordinary skill having the benefit of the present disclosure, that running tool 100 may be advantageously utilized not only for running casing tubulars, but also for essentially any type of tubular structure, including without limitation, drill pipe, landing strings, and/or or flush joint pipe, as will hereinafter become apparent.

As shown in FIG. 1, running tool 100 includes a top end 104 adapted to engage with a top drive assembly drive shaft, such as drive shaft 20 shown in FIG. 21. Running tool 100 is generally cylindrical in configuration having a longitudinal axis 101, and further has a bottom end 160 into which a tubular segment, such as a segment of drill casing is received, as will be hereinafter described.

Figure 2:
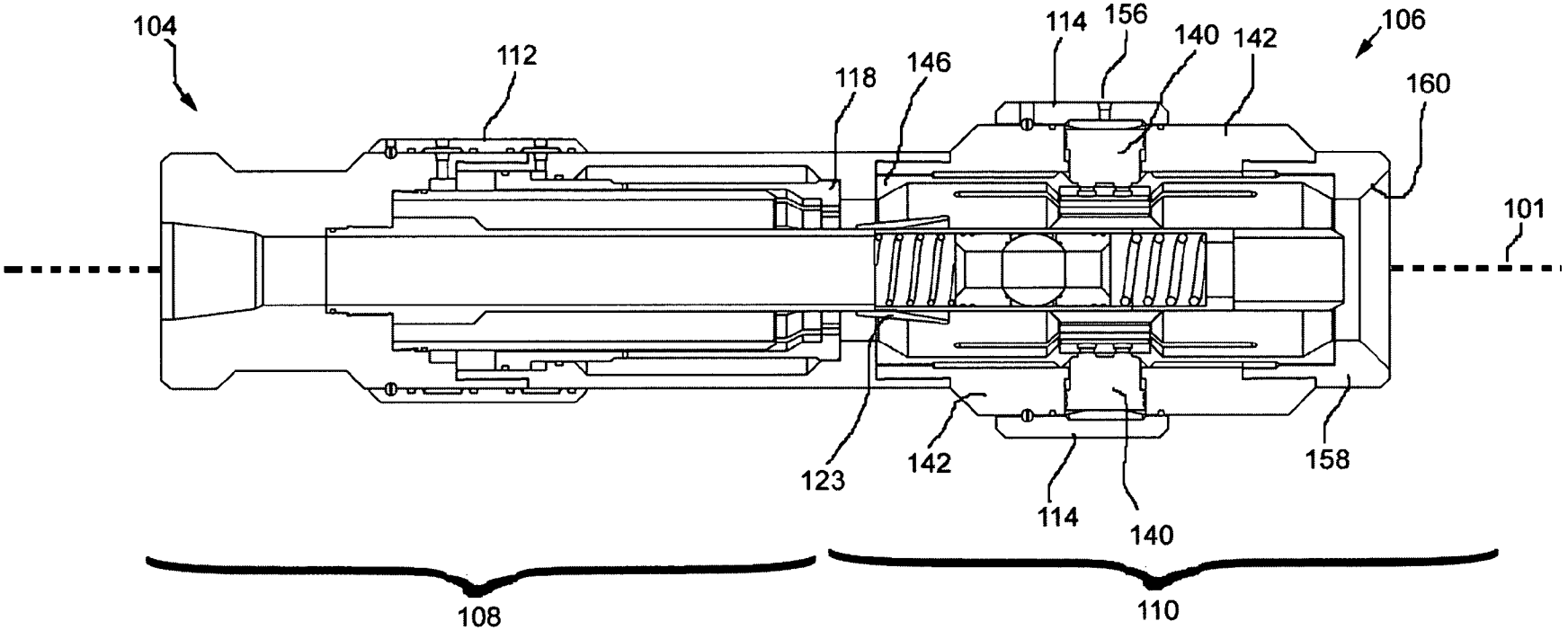
FIG. 2 is a side cross-sectional view of the running tool of FIG. 1 including an elevating/lifting assembly integral with a make-up torquing assembly.

FIG. 2 shows a cross-sectional side view of a tubular running tool 100 in accordance with one embodiment of the invention. In accordance with one embodiment of the invention, tool 100 connects at end 104 directly with a top drive shaft 20, and is multifunctional, inasmuch as it can be used to elevate, make-up, and fill-up a casing assembly. A make-up/torquing assembly 110 of tool 100 can also be used to receive flow back or equalize well pressures, as will hereinafter become apparent.

Referring to FIG. 2, and in accordance with one aspect of the invention, running tool 100 essentially comprises two integral, axially-aligned and cooperating assemblies performing multiple functions, including an elevating/lifting assembly designated generally with reference numeral 108 in FIG. 2, and the aforementioned make-up/torque assembly designated generally with reference numeral 110.

A pair of cylindrical casings or swivels 112 and 114 are associated respectively with the elevating lifting assembly 108 and the make-up/torque assembly 110. As would be appreciated by those of ordinary skill, control lines including hydraulic lines (not shown) are run from casings 112 and 114 to the rig floor 22, and are used to operate the tool from a distance, as will be familiar to those of ordinary skill in the art.

Figure 3:
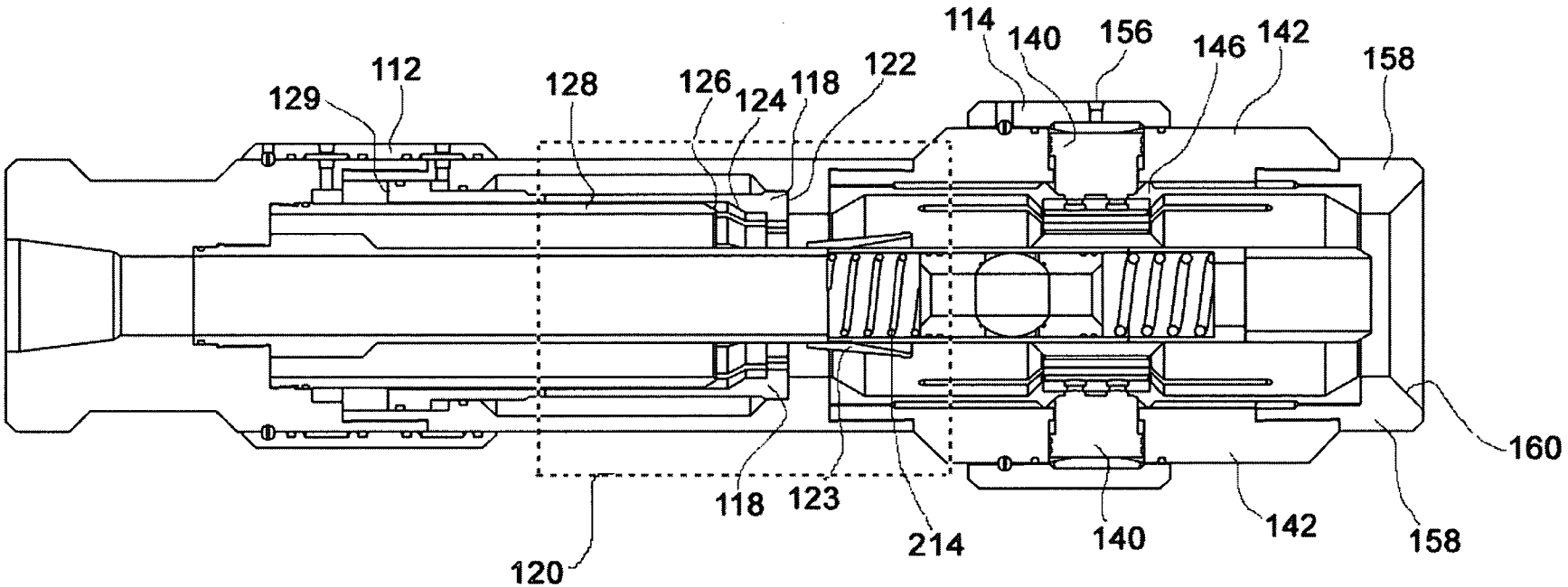
FIG. 3 is a further side cross-sectional view of the running tool of FIG. 1 as well as a top/end portion of a casing prior to insertion into the tool.

As previously noted, tool 100 is in the first place operable in an elevating mode, during which a segment of casing is engaged and lifted. As shown in FIG. 3, a segment of casing 102 having a lifting collar 116 on the top end thereof is inserted into the bottom of running tool 100. The casing 102 is advanced axially into tool 100 until lifting collar 116 is engaged by a lifting collet 118.

Figure 3A:
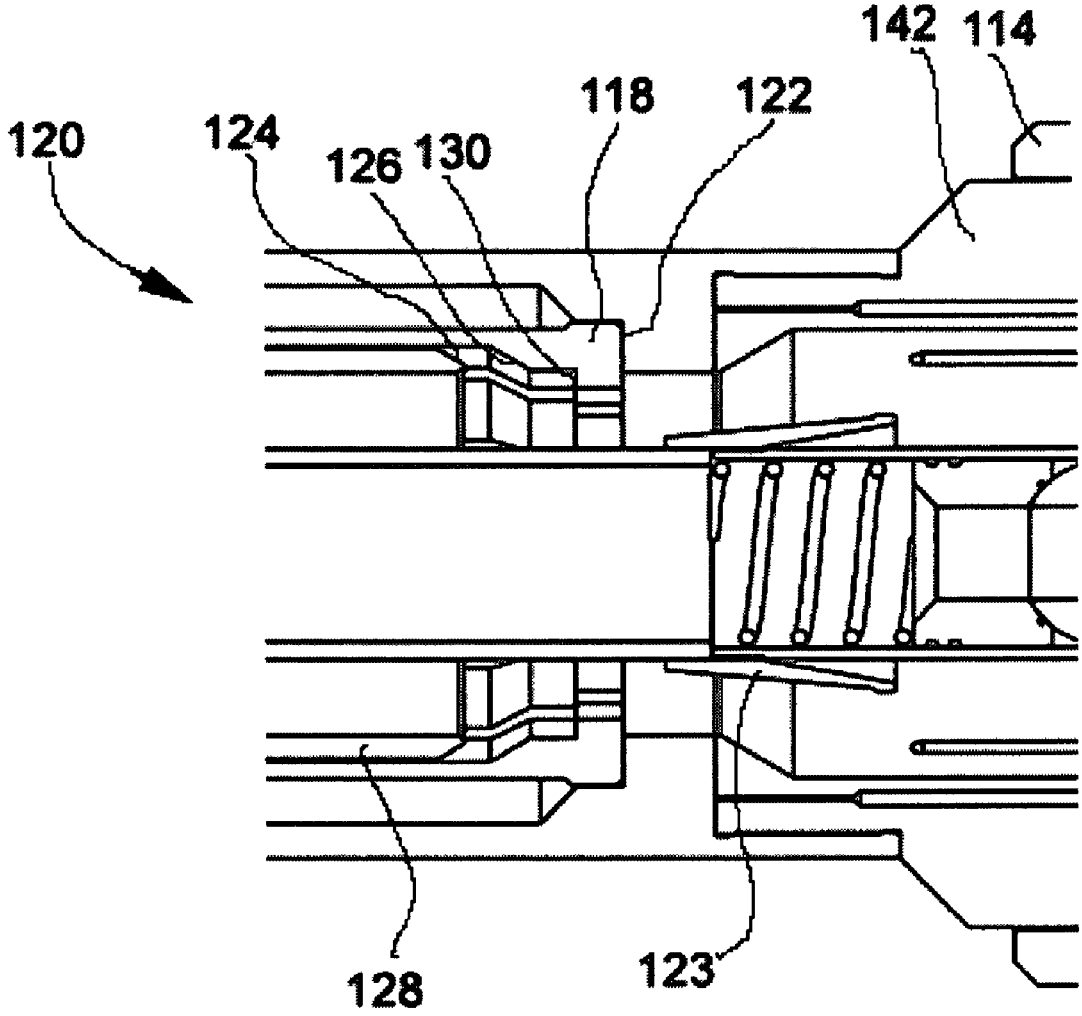
FIG. 3*a* is a detail side cross-sectional view of a portion of the running tool of FIG. 1 including a lifting collet in an unsupported position.
Figure 3B:
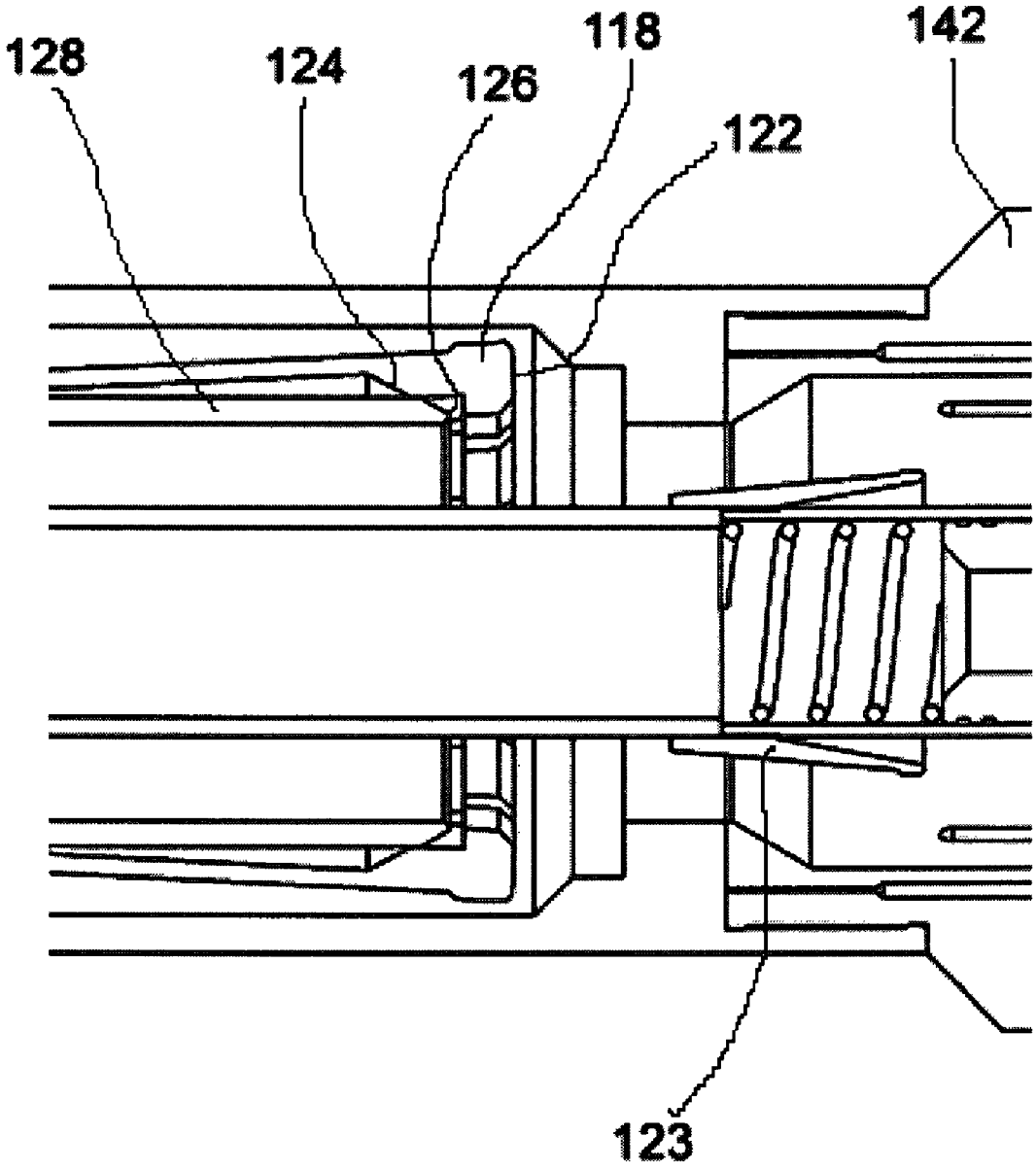
FIG. 3*b* is a detail side cross-sectional view of a portion of the running tool of FIG. 1, including a lifting collet in a release position.

FIG. 3*a* is an enlarged view of the portion of tool 100 within dashed line 120 in FIG. 3 and including lifting collet 118. As can be seen in FIG. 3*a*, collet 118 has a front face 122 and a sloping portion 124 disposed behind the front face 122. For the sake of clarity, the collar 116 of casing 102 is not shown in FIG. 3*a*. However, those of ordinary skill in the art will appreciate that as casing 102 is advanced into tool 100, eventually collar 116 will come into contact with the forward face 122 of collet 118. As pressure is applied against front face 122 by collar 116, collet 118 is forced back, such that sloping portion 124 of collet 118 comes into contact with a sloped portion 126 of a stationary riser or collet lift 128. Further advancement of casing 102 pushes collet 118 even further back, causing riser 128 to deflect collet 118 to a release position, which is shown in FIG. 3*b*.

Figure 4:
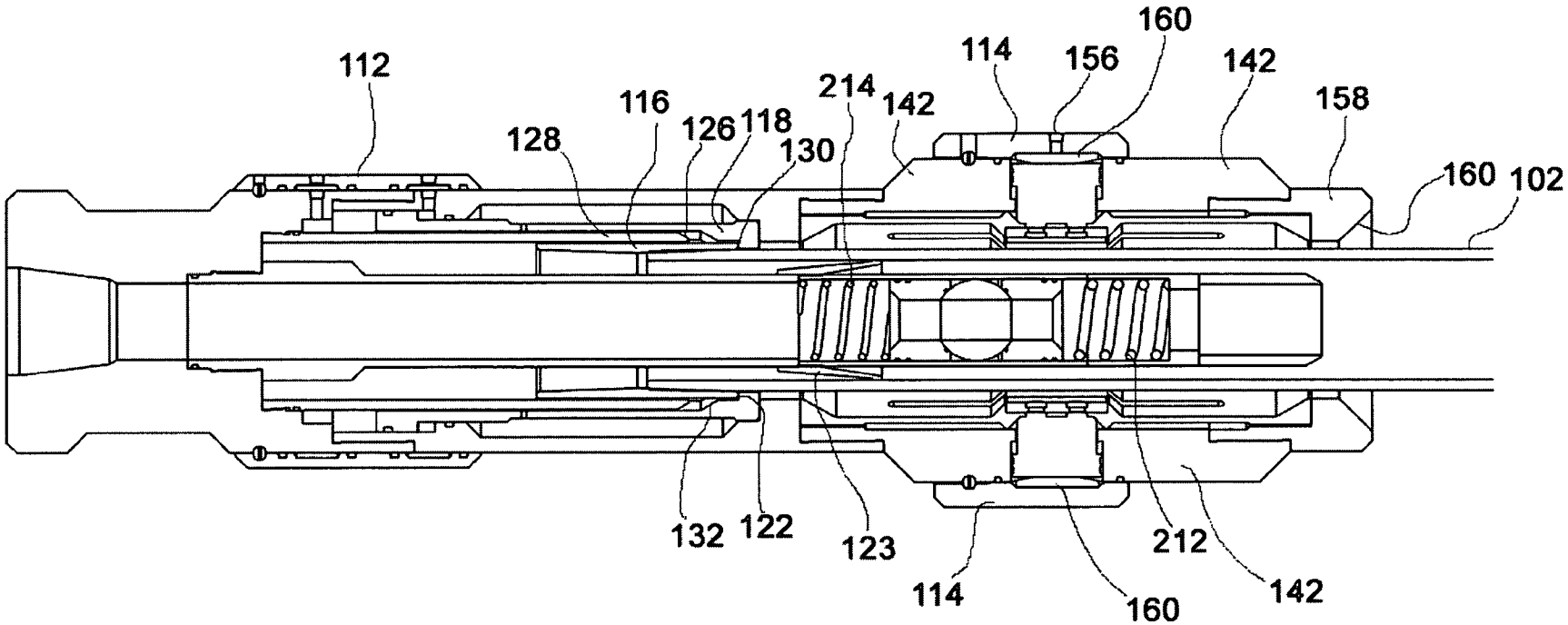
FIG. 4 is a side cross-sectional view of the running tool of FIG. 1 having engaged a top end of a section of casing.

With collet 118 deflected to its release position, collar 116 of casing 102 is allowed to advance past an engaging face 130 of collet. Once this occurs, collet 118 automatically returns to its engaged position, as shown in FIG. 4, with engaging face 130 engaging the lower end 132 of collar 116, thereby preventing withdrawal of casing 102 from running tool 100. In a preferred embodiment, collet 118 is biased by means of a spring (not shown in the Figures) exerting pressure against an upper end 129 of collet 118 and thus tending to maintain collet 118 in the position shown in FIG. 3 absent forces such as the insertion of a casing string pressing collet 118 upward. This biasing makes engagement of the tubular an automatic operation as the tubular is inserted into the tool (or, as the tool is advanced over the tubular, as the case may be).

Once casing 102 is secured in running tool 100 as depicted in FIG. 4, tool 100 can then commence operation in a make-up mode. In make-up mode, hydraulic pressure (fluid or air, although hydraulic fluid is preferred) is applied to the tool, as hereinafter described, to activate various internal mechanisms causing the casing to be grasped in a manner sufficient to allow top drive 18 to impart rotational torquing force to the casing for the purposes of make-up and break-up.

It is to be noted that a conventional swab cup/packer cup 123 is disposed within make-up module 110 and is adapted to form a seal 125 against the outer circumference of a tubular inserted into tool 100, as is shown in FIG. 4.

Referring first to FIG. 4, it can be observed that tool 100 includes a plurality of pistons 140 radially oriented with respect to the longitudinal axis 101 of tool 100, and received within the body 142 of make-up/torque assembly 110 of tool 100. As will hereinafter be described, the make-up mode is realized through application of hydraulic pressure forcing pistons 140 radially inward with respect to long axis 101 and creating a compression force around the perimeter of a section of casing 102 engaged in tool 100 as previously described.

Figure 5:
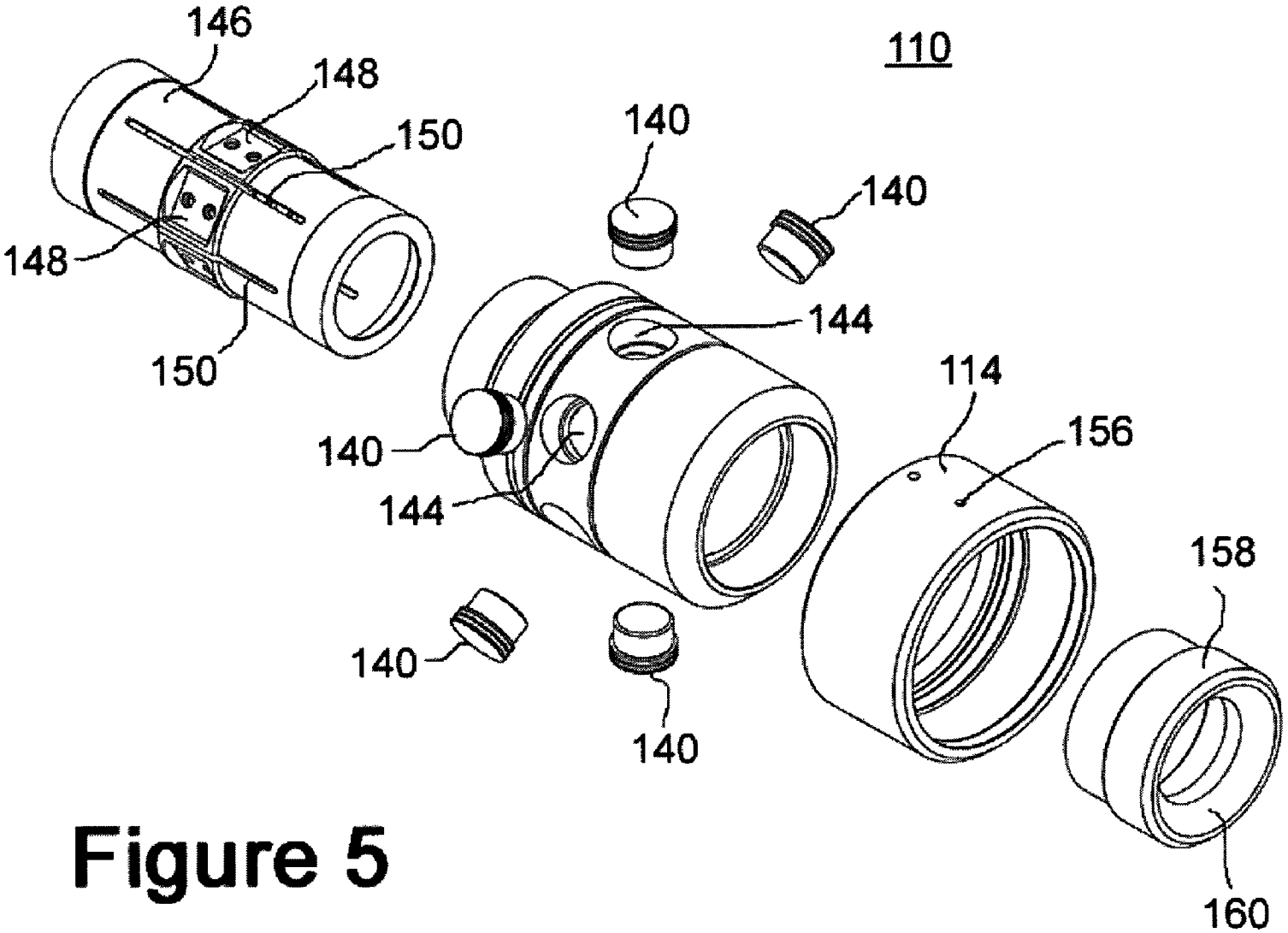
FIG. 5 is an exploded, isometric view of the make-up/torque assembly in the running tool of FIG. 1.

FIG. 5 is an exploded isometric view of the make-up/torque assembly 110 of tool 100 including, among other components, body portion 142, casing 114, and a plurality of pistons 140. As shown in FIG. 5, pistons 140 are preferably evenly spaced around the circumference of body portion 142 and are seated within piston cylinders 144 formed in body portion 142.

Figure 6A:
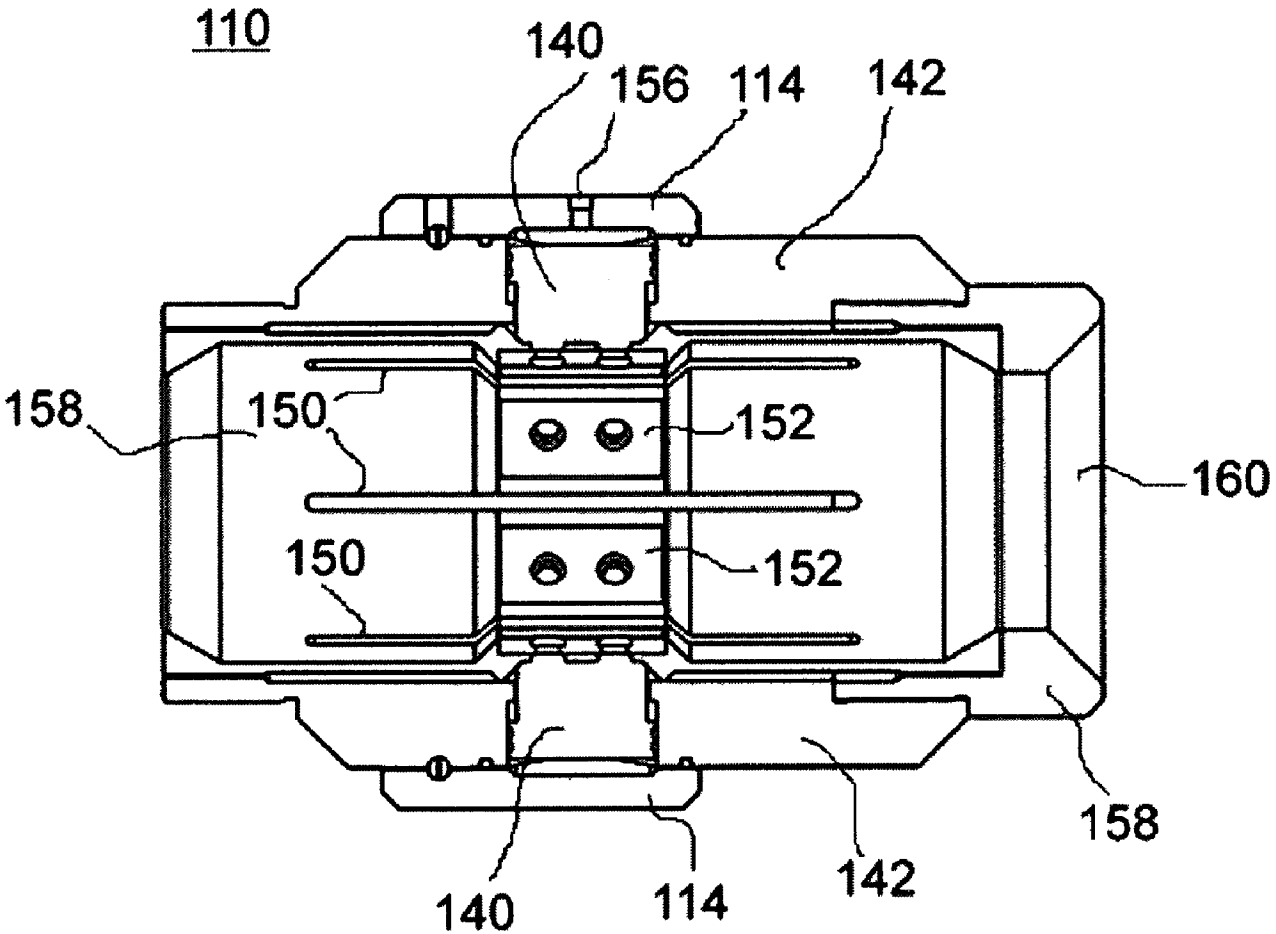
FIG. 6*a* is a side, cross-sectional view of the make-up/torque assembly in the running tool of FIG. 1 prior to operation in a make-up mode of operation.
Figure 6B:
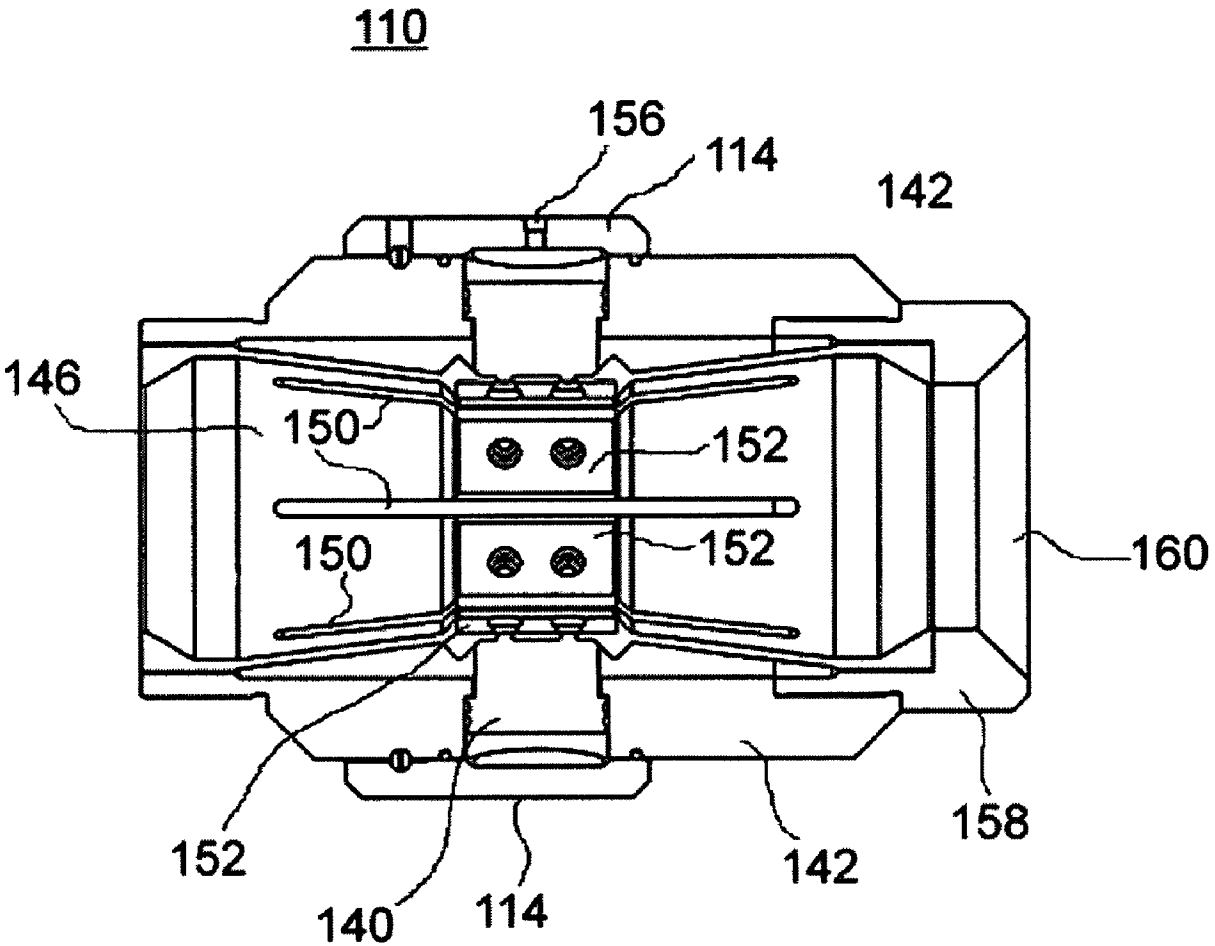
FIG. 6*b* is a side, cross-sectional view of the make-up/torque assembly in the running tool of FIG. 1 actuated into operation in a make-up mode.

FIG. 6 is a side, cross-sectional view of make-up/torque assembly 110. Referring to both FIG. 5 and FIG. 6, it can be seen that collet structure 146 is substantially cylindrical, having a plurality of flattened compression sites 148 formed into the outer circumference thereof. Preferably, collet structure 146 is made of steel, and compression sites 148 are formed by a conventional milling operation, as would be familiar to those of ordinary skill. In addition, collet structure 146 has a plurality of longitudinal slots 150 extending along a portion of the length of body 142. In the presently preferred embodiment, slots 150 are interposed between each pair of compression sites 148, as shown.

In FIG. 6, it can be observed that pistons 140 are received within holes 144 and are surrounded by and held in place by means of cylindrical casing or swivel 114. As shown, body 142 and collet structure are configured such that when assembled, each piston 140 is disposed radially proximal to a respective compression site 148 on collet structure 146.

Figure 7:
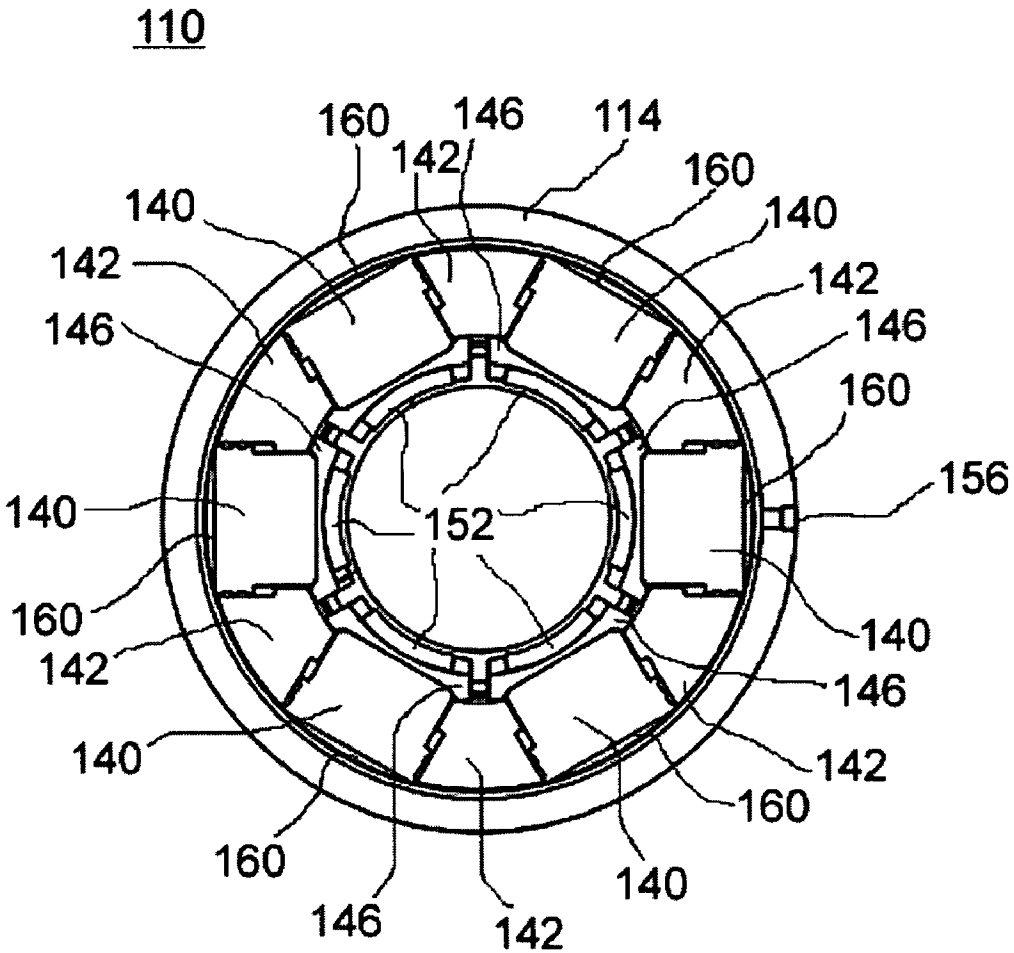
FIG. 7 is an end, cross-sectional view of the make-up/torque assembly in the running tool of FIG. 1.

FIG. 7 is a cross-sectional end view of make-up/torquing assembly 110. It is apparent in FIG. 7 that a slip element 152 is interposed between the face of each piston 140 and its corresponding compression site 148. In one embodiment, piston slips 152 are composed of steel and are designed to be a periodically replaced over the useful life of tool 100. Those of ordinary skill in the art will appreciate, however, that the composition of slips 152 can be selected from materials other than steel depending upon the particular application and the nature of the tubular structure for which the tool is to be used.

Shown in FIGS. 4, 5, 6, and 7 is a hydraulic port 156 formed in swivel 114 and located such that it permits the control of hydraulic pressure within the sealed and substantially annular space 160 formed between casing 114 and body 142 circumferentially above the pistons 140.

A bottom receptacle component 158 serves to secure collet structure 146 within body 142 and preferably has a flanged perimeter 160 facilitating insertion of tubulars (e.g., casing) into tool 100.

To operate tool 100 in make-up mode, hydraulic pressure is created in the compression annulus 160, thereby applying hydraulic force evenly upon the top of each piston 140. This force tends to drive pistons 140 radially inward, causing deformation of collet structure 146. This deformation can be readily observed in FIG. 8, which is a side, cross-sectional view of make-up/torque assembly 110 upon application of pressure via hydraulic port 156 into compression annulus 160. As will be appreciated by those of ordinary skill, the inward radial displacement of pistons 140 eventually causes slips 152 to come into contact with and frictionally grip the casing segment 102 engaged within tool 100. Advantageously, the arrangement as described results in relatively uniform compression force being applied around the circumference of casing 102.

As would be apparent to those of ordinary skill in the art, when make-up/torquing assembly 110 is actuated through application of hydraulic pressure through port 156, top drive 18 can impart torquing force to the casing string, which is secured within tool 100 by virtue of the compression forces applied by pistons 140.

As previously mentioned, and in accordance with a significant aspect of the invention, tool 100 integrates multiple functions, including elevation of tubulars, as described above, make-up processes, as described above, and, as will hereinafter become apparent, control of drilling fluids following casing make-up.

To this end, tool 100 further comprises a valve assembly 180 which is disposed generally within the make-up/torque module 110 (see FIG. 2). FIG. 9 is a side cross-sectional view of valve assembly 180 in accordance with the presently disclosed embodiment of the invention. Reference can be made to the dashed line designated with reference numeral 180 in FIG. 8 corresponding to the valve assembly shown in isolation in FIG. 9.

As shown in FIG. 9, valve assembly 180 comprises a substantially cylindrical body which, in the presently preferred embodiment of the invention, comprises separate but integrated components, including an outer cylindrical sheath 182, a first body portion 184 partially surrounded by sheath 182 and defining a substantially cylindrical inner wall 186, a second body portion 188 mutually engaged with the first body portion and defining a substantially cylindrical inner wall formed to have an annular retaining structure 192, and a third substantially cylindrical body portion 194, mutually engaged with the second body portion 188 and defining a tapered bottom end 196 of assembly 180. Tapered end 196 tends to guide a tubular structure such as a casing being inserted into the tool 100 in a manner in which valve assembly 180 is directed into the inner diameter of the inserted tubular.

Figure 8:
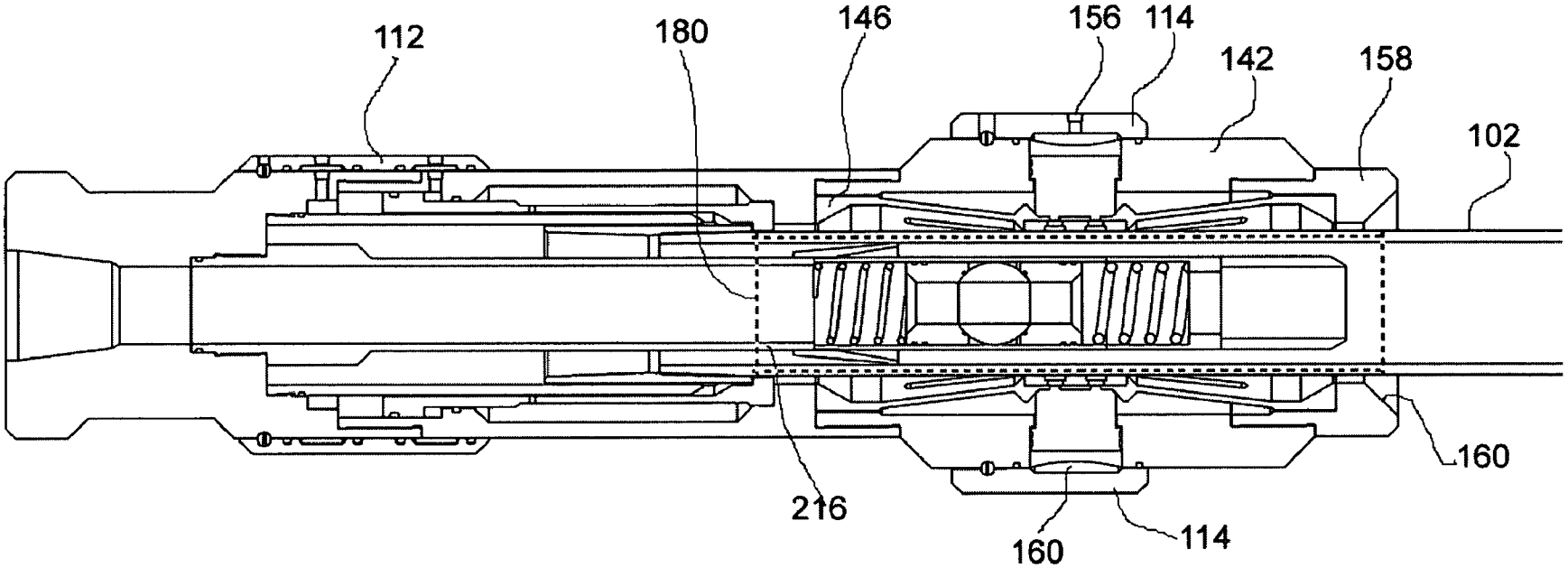
FIG. 8 is a side, cross-sectional view of the running tool of FIG. 1 with the make-up/torquing assembly actuated to a make-up mode of operation.
Figure 9:
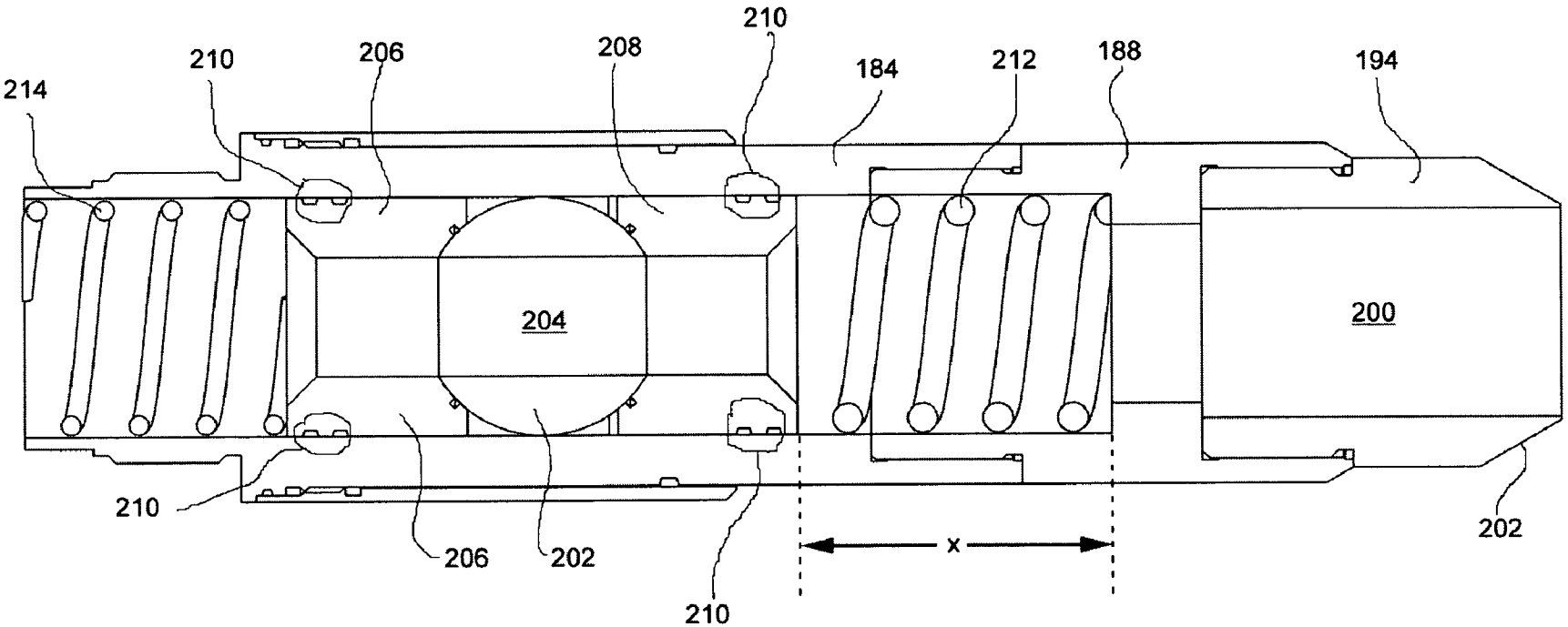
FIG. 9 is a side, cross-sectional view of a valve assembly in the running tool of FIG. 1 with a ball-valve assembly therein in an open position.
Figure 10:
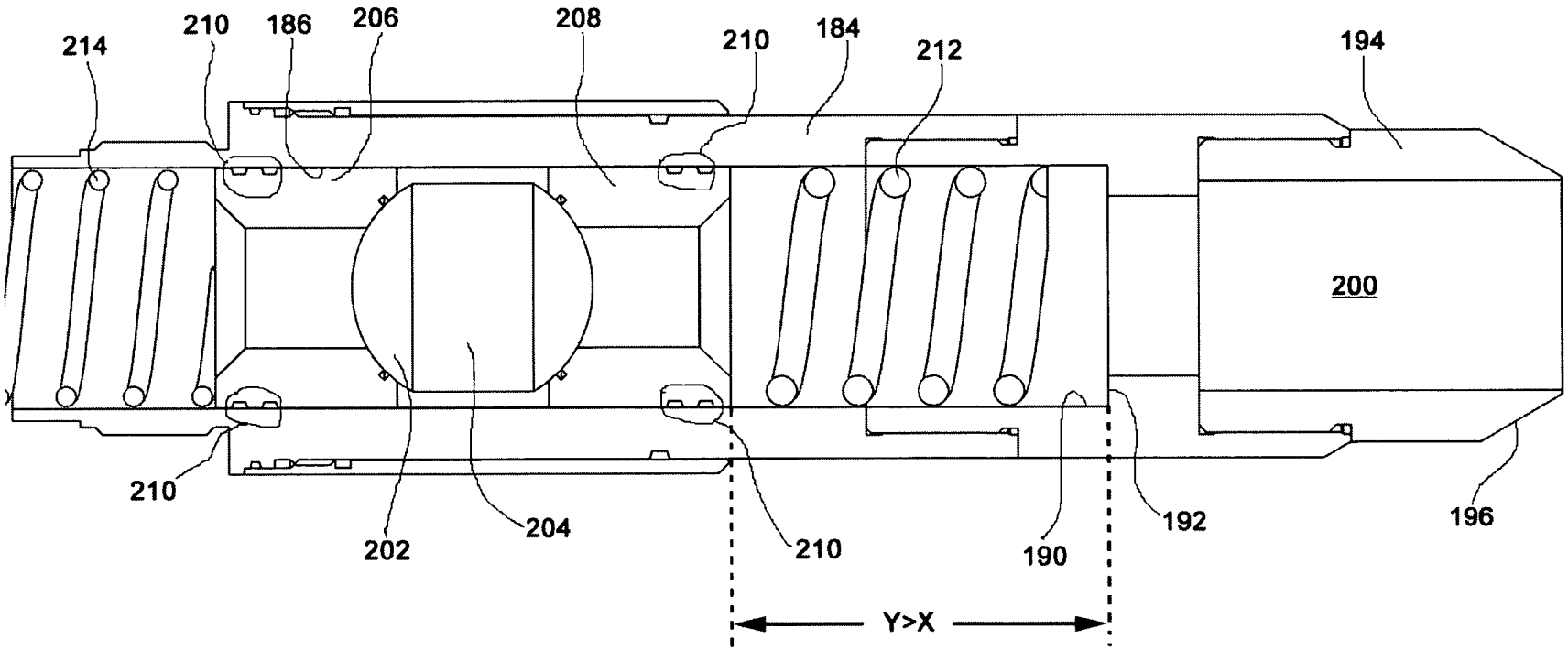
FIG. 10 is a side, cross-sectional view of the valve assembly from FIG. 9 with a ball-valve assembly therein in a closed position.

Through consideration of FIG. 8, it is apparent that valve assembly 180 defines a fluid channel 200 for the passage of drilling fluid, for example, the fluid channel 200 being selectively opened or restricted through actuation of a ball valve 202 having an annulus selectively brought in-line with fluid channel 200. FIGS. 8 and 9 shows ball valve 202 in an open position permitting fluid flow through valve assembly 180. FIG. 10 shows ball valve 202 in a closed position such that fluid flow is obstructed.

As shown in FIGS. 9 and 10, ball valve is disposed between two annular valve seats 206 and 208. Valve seats 206 and 208 are sealed against the inner diameter 186 of valve body 194 by means of O-ring seals 210. With this arrangement, valve seats 206 and 208 can move axially within body portion 184.

A first biasing mechanism, in the form of a coiled spring 212 is disposed between valve seat 208 and retaining structure 192. A second biasing mechanism, in the form of a coiled spring 214 and an inner cylindrical portion 216 of the elevating/lifting module 108. As shown in FIGS. 9 and 10, the inner diameter 218 of cylinder 216 is smaller than the inner diameter of body portion 184 of valve assembly 180, such that an end 220 of cylinder serves as a retaining structure for one end of spring 214.

Figure 11:
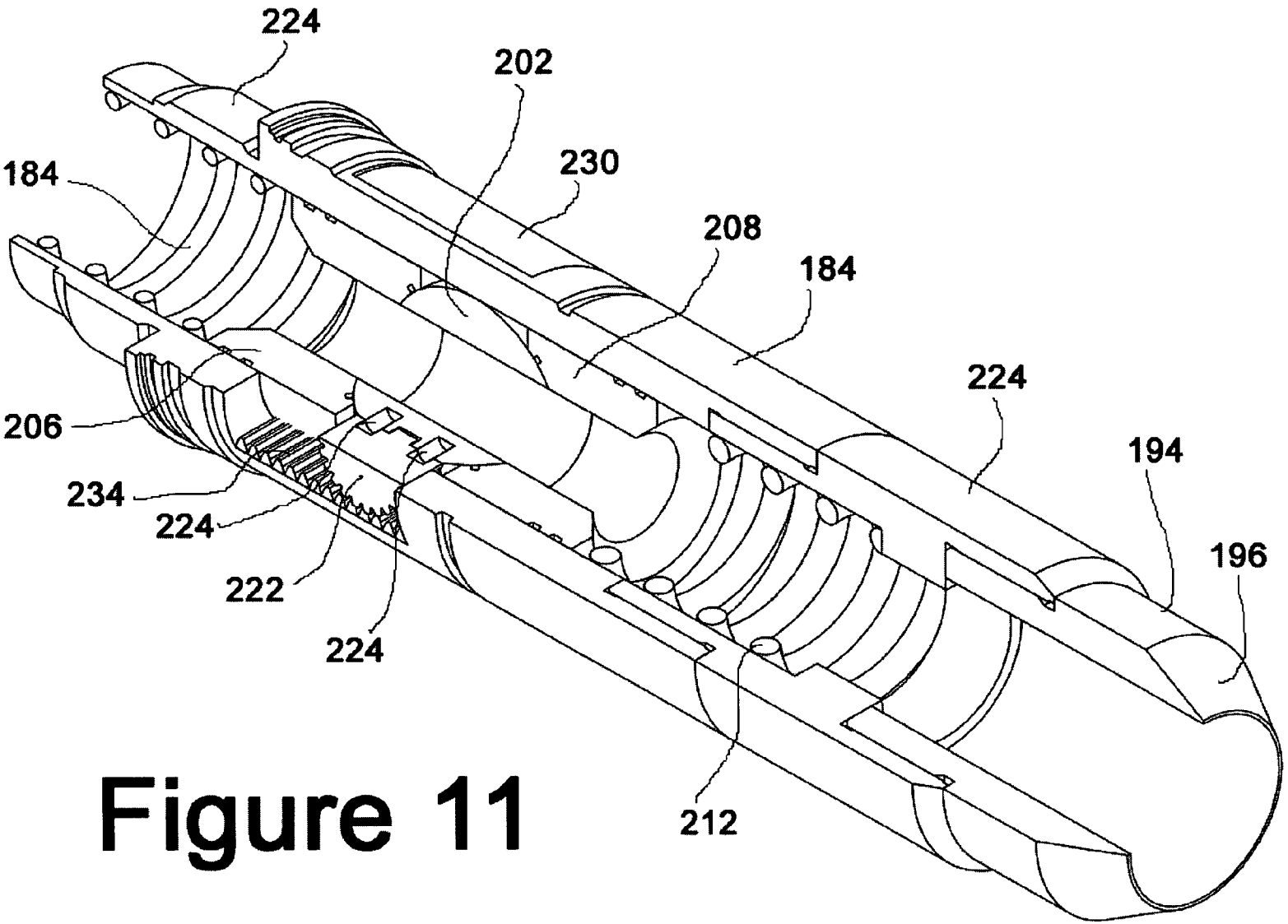
FIG. 11 is an isometric, partially cut-away view of the valve assembly from FIG. 9.
Figure 12:
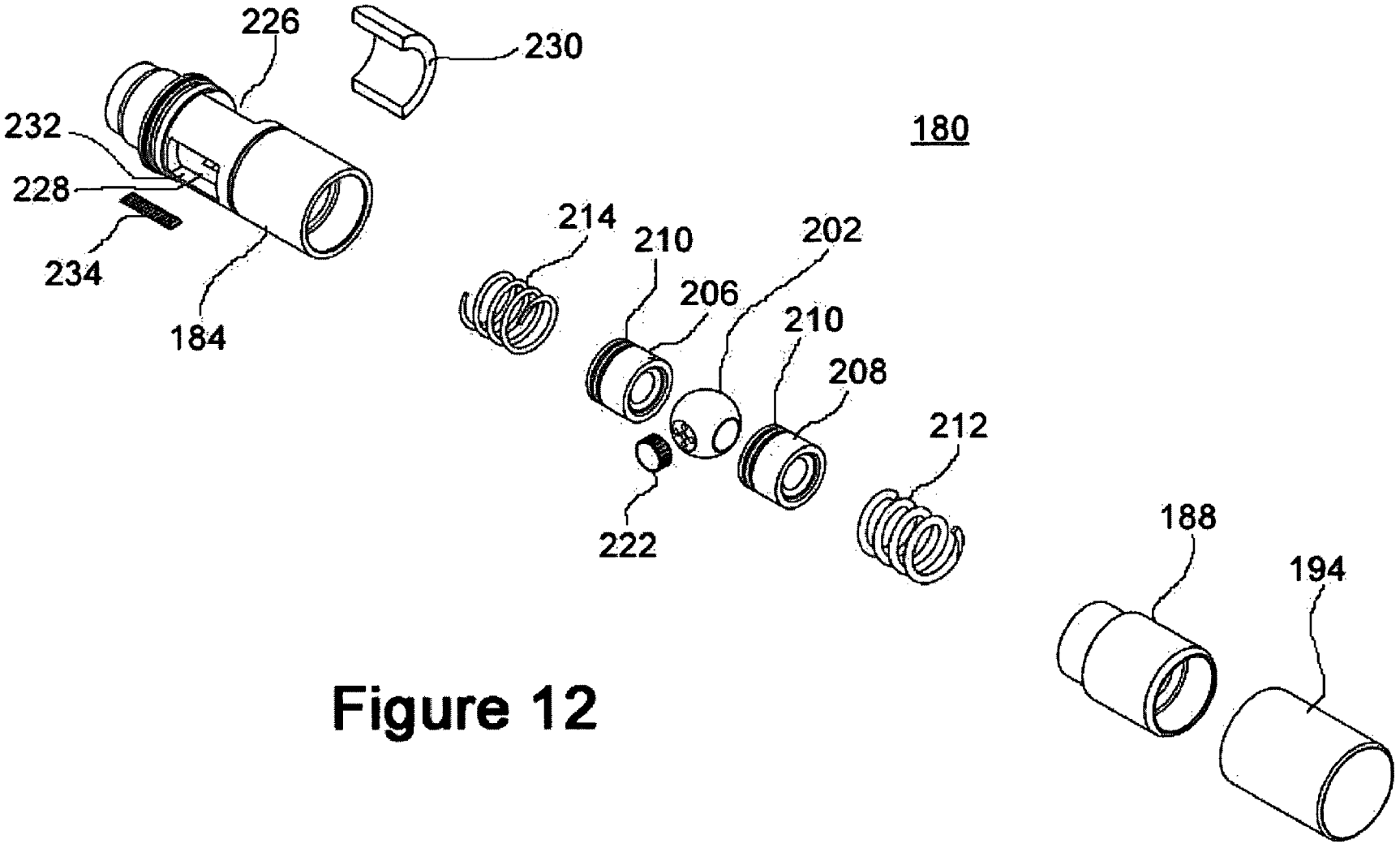
FIG. 12 is an exploded isometric view of the valve assembly from FIG. 9.

FIG. 11 is a partially cut-away isometric view of valve assembly 180. FIG. 12, is an exploded isometric view of valve assembly 180. In FIGS. 11 and 12, it can be observed that a cylindrical pinion gear is rigidly coupled to an outer side of valve ball 202, by means of a plurality of securing pins 224 (not shown in FIG. 12). As is best seen in FIG. 12, portions 226 and 228 of body 184 are cut away, with a semi cylindrical insert 230 being provided to occupy cut-out portion 226 and cut-out portion 228 being left open to accommodate pinion gear 222. Disposed on a bottom portion 232 of cut-out 228 is a flat rack gear 234 having teeth sized to be engaged by the teach of pinion gear 222.

As would be apparent to those of ordinary skill in the art, the rack-and-pinion arrangement of gear 222 and rack 234 is such that lateral movement of the combination of valve seats 206 and 208 and valve ball 202 results in rotational movement of valve ball 202. Specifically, in the orientation of FIGS. 9 and 10, movement of valve seats 206 and 208 axially to the right results in rotation of valve ball 202 in a clockwise direction, whereas axial movement of valve seats 206 and 208 to the left results in rotation of valve ball 202 in a counter-clockwise direction. By comparison of FIGS. 9 and 10, it can be observed that when the bottom side 236 valve seat 208 is positioned a distance X from retaining structure 192, valve ball is oriented in an open position permitting fluid flow through valve assembly 108. This is shown in FIG. 9.

However, when valve seats 206 and 208 are moved laterally to the left, bottom side 210 of valve seat 208 is positioned a distance Y from retaining wall 192, where Y is greater than X. As a result of the rack-and-pinion arrangement of valve ball 202, this rotates valve ball 202 into a closed position obstructing fluid flow through valve assembly 180. This is shown in FIG. 10.

In the presently preferred embodiment of the invention, the expansion and compression forces of springs 212 and 214 are selected to cause valve assembly 180 to open automatically (FIG. 9) whenever fluid pressure within casing reaches a predetermined threshold value. The casing fluid pressure exerts force upon bottom side 210 of valve seat 208, and when such force along with the expansion force of spring 212 exceeds the compression force of spring 214, valve seats 208 and 206 are pushed to the right causing the valve to open (FIG. 9). Conversely, when casing pressure is below a preselected level, the force exerted on the bottom side 210 of valve seat 208 is less than the combined expansion force of spring 214 and/or the compression force of spring 212, spring 214 will return valve assembly to the closed position shown in FIG. 10.

Those of ordinary skill in the art will appreciate that the biasing of the position of Valve seats 206/208 and valve ball 202 might be accomplished by means other than coiled springs such as is depicted in the Figures. Nonetheless, in the presently preferred embodiment, the respective expansion/compression coefficients of biasing mechanisms (springs) 212 and 214 are such that the valve ball 202 is oriented in the closed position (FIG. 10) absent sufficient casing fluid pressure to drive seats 206/208 upward thereby opening ball valve assembly 180 as described above.

Figure 13:
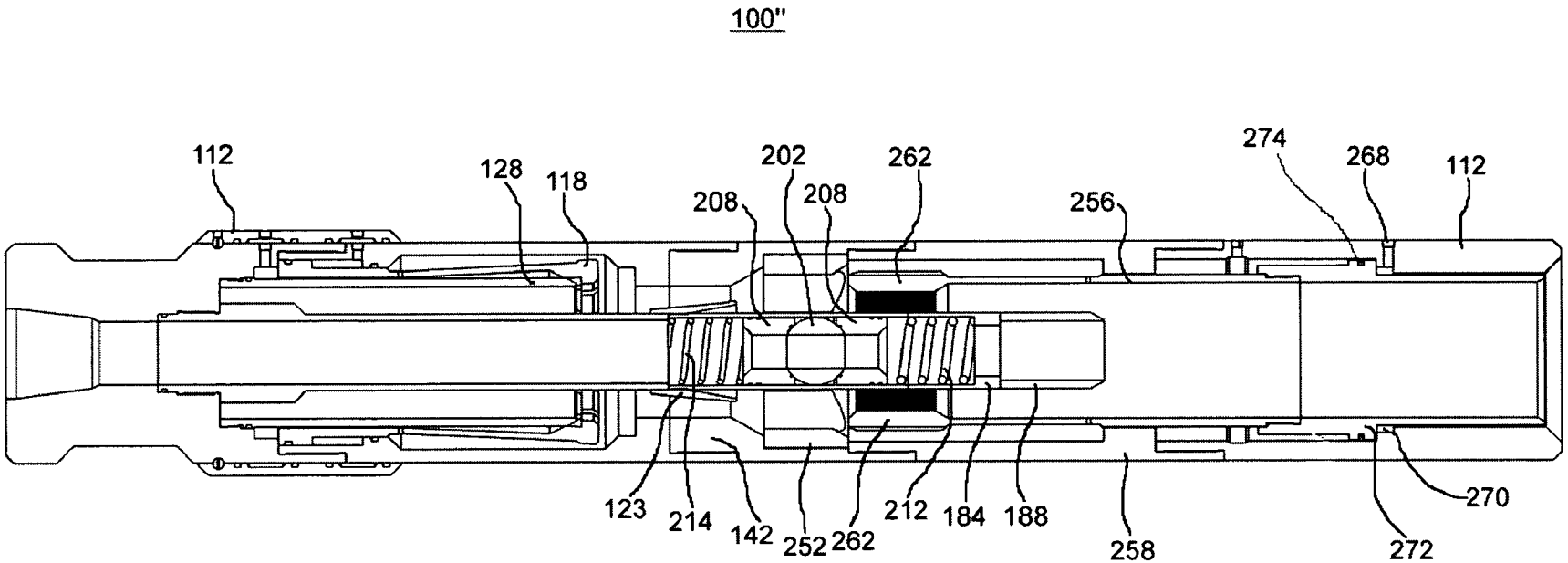
FIG. 13 is a side, cross-sectional view of a running tool in accordance with an alternative embodiment of the invention.
Figure 14:
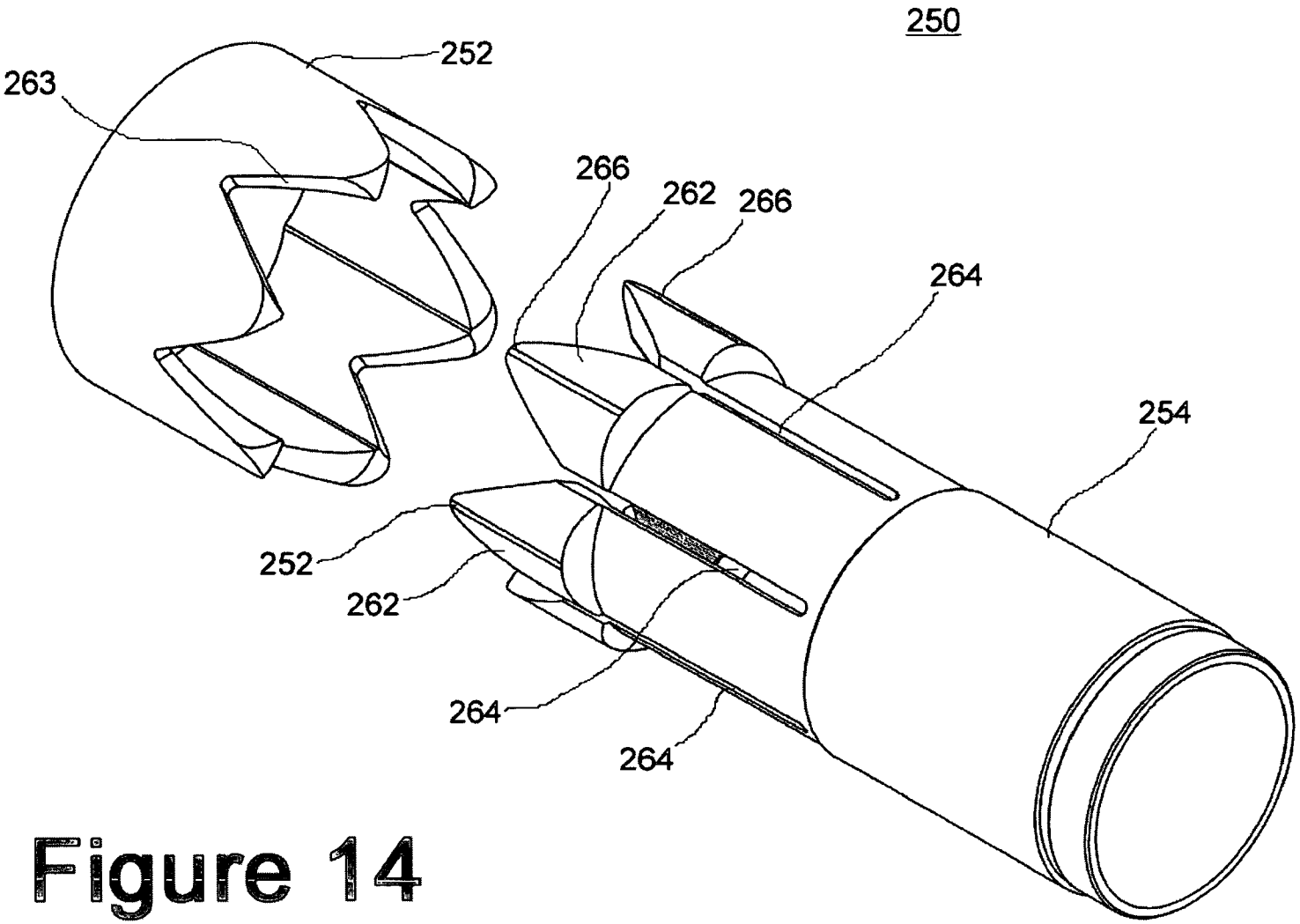
FIG. 14 is an isometric view of a collet and collet housing disposed within the running tool shown in FIG. 13.

Referring to FIG. 13, there is shown a side cross-sectional view of a casing running tool 100' in accordance with a variation of the present invention. In the embodiment of FIG. 13, the make-up/torque module 110 in the embodiment of the previous Figures is modified to include a two-piece cam assembly 250 that is shown in the isometric view of FIG. 14 and in the cross-sectional end view of FIG. 15.

In this alternative embodiment, tool 100' incorporates a cam assembly 250 comprising a cam housing 252 and a cam collet 254. Cam housing 252 has a contoured inner diameter 260 best observed in the end view of FIG. 15. Cam collet 254 comprises a substantially cylindrical body portion 255 carrying a plurality of compressible gripping structures 262 formed at one end, each gripping structure 262 having a grooved inner gripping surface such as the exemplary surface identified with reference numeral 264 in FIG. 15.

With reference to FIG. 13, cam housing 254 is immovably secured in place, while cam collet 254 is permitted to move axially within the outer body 258 of tool 100'. (As shown in FIG. 13, the outer body 258 surrounding collet assembly 150 may be comprised of a plurality of separate, interconnecting segments, to facilitate fabrication and assembly, as would be apparent to those of ordinary skill.

In FIG. 13, cam collet 254 is shown in a released position in which gripping structures 262 are not engaged within cam housing 252. In this exemplary embodiment, each gripping structure 262 is spaced apart from its neighboring gripping structures 262 by a slot 264. Moreover, each gripping structure 262 itself has a slot 266 formed therein, dividing each gripping structure 262 longitudinally in half.

When in the released position of FIG. 13, a tubular structure such as drill casing can be inserted into tool 100' to be engaged by lifting collet 118 as previously described with reference to FIGS. 3, 3*a*, and 3*b*. As would be appreciated by persons of ordinary skill, lifting collet is not intended to impart any rotational force (torque) on an inserted tubular. For various purposes, including the make-up and break-up of a casing string, it is necessary to rotate the tubular by mechanical coupling of the tubular to the top drive shaft 20.

To accomplish this, cam structure 250 is actuated into a gripping position in which gripping structures 262 are axially propelled into collet housing 252. Actuation of cam structure 250 in this way is achieved by application of hydraulic pressure into a hydraulic port formed in outer housing 258, as can be observed in FIG. 13. Application of hydraulic pressure increases the pressure within a space 270 located immediately behind a cylindrical coupling 272 body 254 of collet 255. Cylindrical body 254 is sealed by means of a conventional seal 274 against the inner surface of housing 258, so that increasing pressure in the volume 270 is exerted against the end of coupling 272, tending to propel cam collet 254 forward and into collet housing 252. As collet 254 travels forward, the distal ends of gripping structures 262 are engaged within conforming profile 263 of collet housing 252. Once engaged, rotation of collet housing will cause rotation of collet 254, as would be apparent to those of ordinary skill.

As will further be appreciated by those of ordinary skill in the art, cam housing 252 is substantially cylindrical and has a contoured inner the inner contour 253 of housing 252 is such that rotation of cam collet 254 with respect to cam housing 252 will cause the inner walls of housing 252 to exert inward radial force on gripping structures 262. This inward radial force will cause gripping structures 262 to flex inwardly, this flexibility being afforded due to the creation of slots 264 therebetween, and is further achieved by creation of slots 266 in each structure 262.

Figure 15:
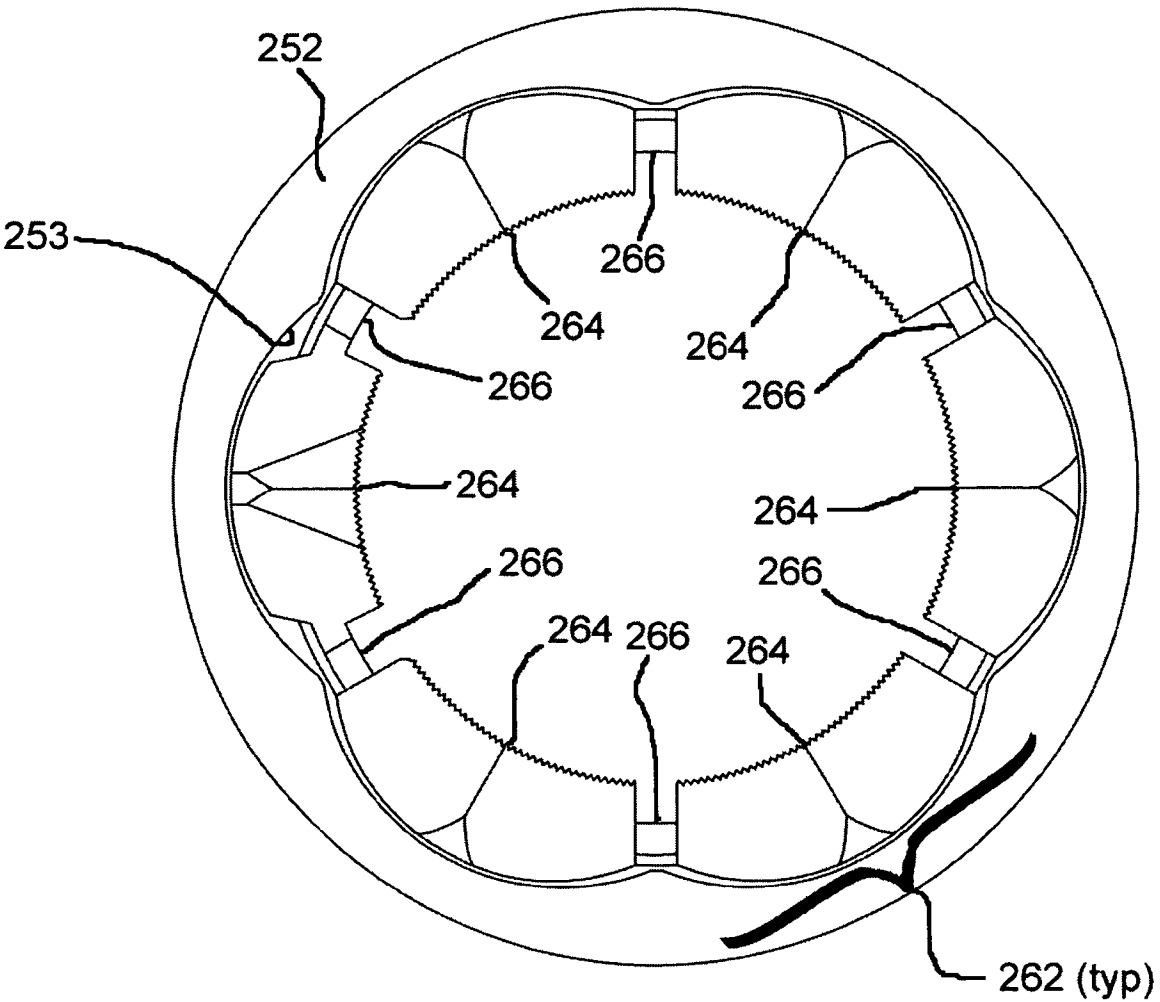
FIG. 15 is an end cross-sectional view of the collet and collet housing from the embodiment of FIG. 13.

Preferably, and as can be observed in FIG. 15, inner surfaces 274 of each gripping structure 262 are grooved to enhance their ability to grip a tubular extending through tool 100'. Thus, under control of pressure applied through port 258, gripping structures 262 can be selectively forced radially inward to make contact with a tubular structure (not shown in FIG. 13), giving tool 100' the ability to impart the rotational force of the tubular necessary for make-up or break-up of tubular strings.

Figure 16:
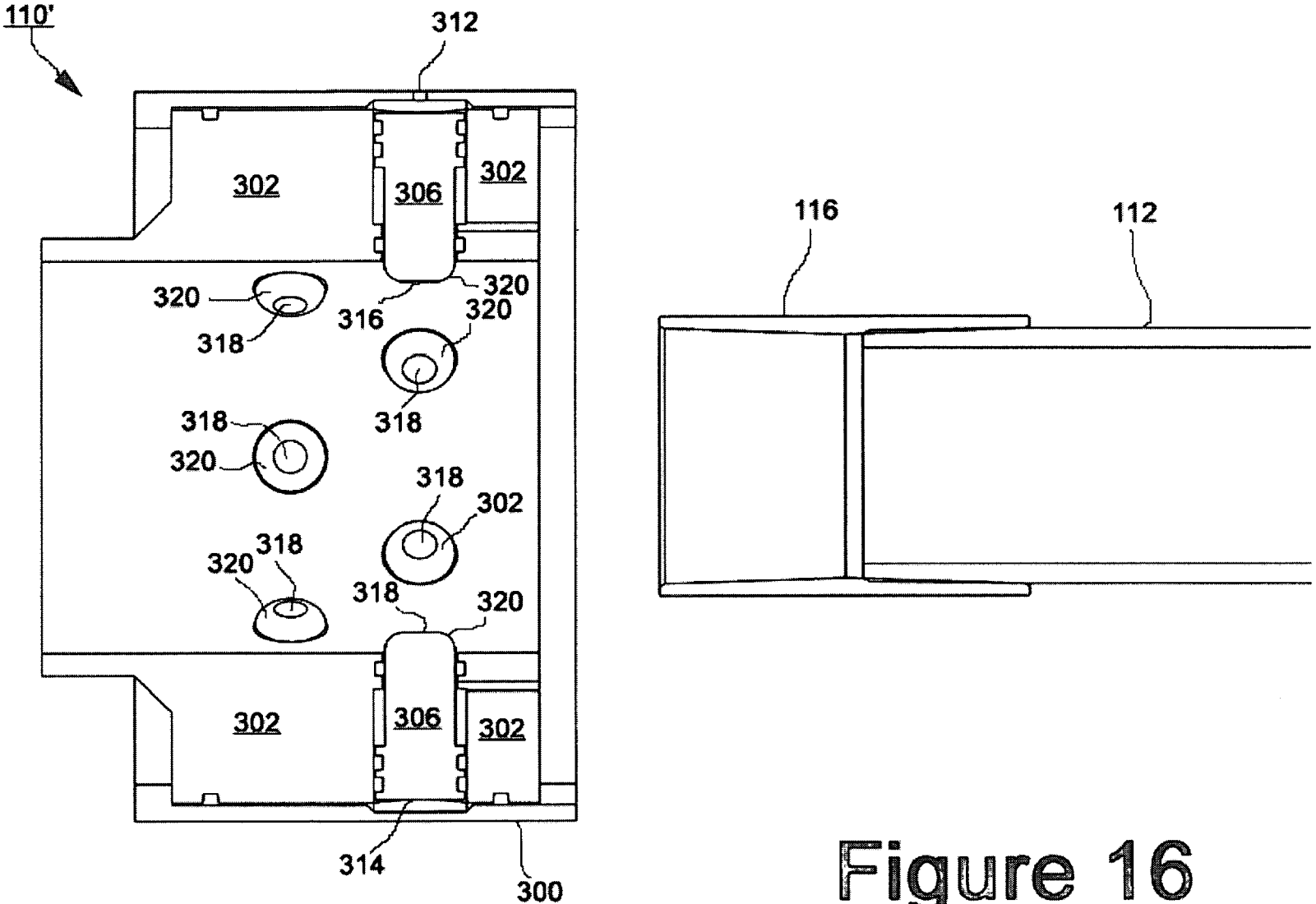
FIG. 16 is a side cross-sectional view of a make-up/torque module in a casing running tool in accordance with an alternative embodiment of the invention.

Turning now to FIGS. 16 through 20, there is shown an alternative embodiment of the invention. In particular, the alternative embodiment is distinguished from the embodiments described above in that it incorporates an alternative make-up/torque module 110'. FIG. 16 is a side cross-sectional view of make-up/torque module 110 make-up/torque module 110' in accordance with this alternative embodiment. Shown in FIG. 16 is a tubular, in this exemplary case a segment of casing 102 having a collar 116, as is similarly depicted in FIG. 1.

In the embodiment of FIG. 16, make-up/torque module 110 make-up/torque module 110' comprises an outer cylindrical body 300 circumferentially surrounding a radial piston cylinder body 302 having a substantially cylindrical inner diameter designated "ID" in the Figures. Cylinder body 302 has a plurality of radially-oriented hollow cylinders 304 formed therein, each cylinder 304 supporting a piston 306 and enabling piston 306 to be selectively forced or driven radially inward and outward, as represented by bidirectional arrows 308 shown in FIG. 19.

Figure 17:
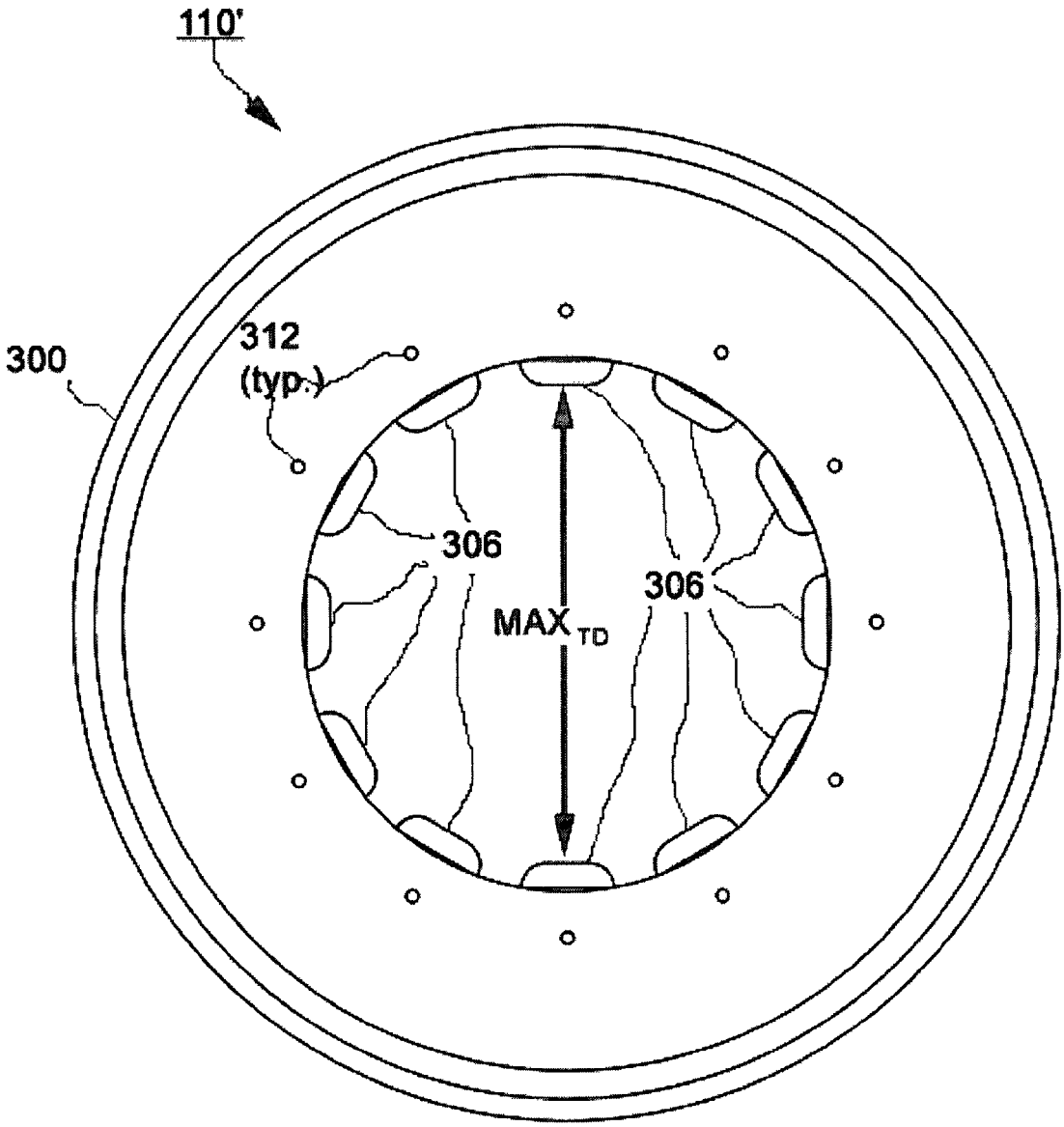
FIG. 17 is an end view of the make-up/torque module from FIG. 16 in an open or release state.

FIG. 17 is an end cross-sectional view of make-up/torque module 110' showing the plurality of pistons 306 in a fully retracted radial position such as is also depicted in FIG. 16. As would be appreciated by those of ordinary skill in the art, a sealing mechanism including in the presently preferred embodiment a plurality of sealing rings 310 are provided to seal each piston 306 within the cylinder 304 in which it is contained.

As is apparent particularly in the end cross-sectional view of FIG. 17, when pistons 306 are in a fully retracted or open position (also shown in FIG. 16), an internal diametric clearance $MAX_{TD}$ is defined within piston cylinder body 302. $MAX_{TD}$ is the maximum diameter of a tubular for which the embodiment may be employed. Of course, those of ordinary skill in the art will appreciate that a make-up/torque module 110' can be implemented in any dimension depending upon the particular requirements of a given implementation.

It is apparent in FIGS. 16 through 20 that hydraulic actuation ports 312 are formed in piston cylinder body 302, ports 312 being disposed behind a proximal end 314 of each piston 306. As would be appreciated by those of ordinary skill in the art, the application of hydraulic pressure into ports 312 will tend to drive each piston 306 radially inward while rings 310 maintain a hydraulic seal against the walls of cylinders 304.

In the presently preferred implementation of the embodiment of FIGS. 16-20, a distal end 316 of each piston 306 includes a substantially flattened central face portion 318 and a surrounding contoured perimeter portion 320. Face portion 318 may be textured, as desired, to enhance the gripping ability of the piston when deployed around a tubular element, as would be apparent to those of ordinary skill.

As will also be appreciated by those of ordinary skill, FIGS. 16 and 17 depict make-up/torque module 110' in an open position wherein each piston 306 is withdrawn to its radially outward extreme, defining $MAX_{TD}$ as shown in FIG. 17.

Figure 18:
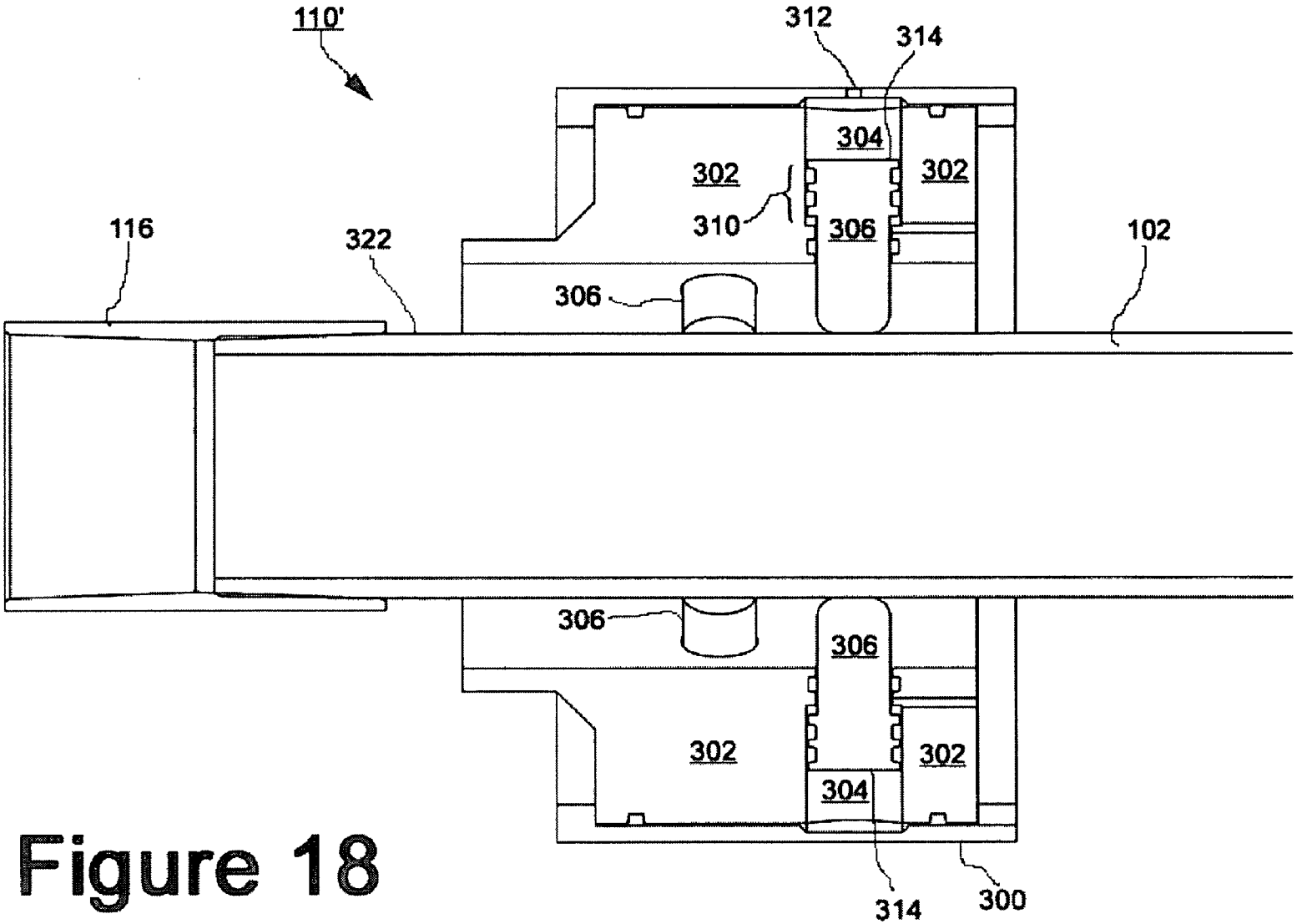
FIG. 18 is a side cross-sectional view of the make-up/torque module from FIG. 16 with a tubular element being engaged therein.
Figure 19:
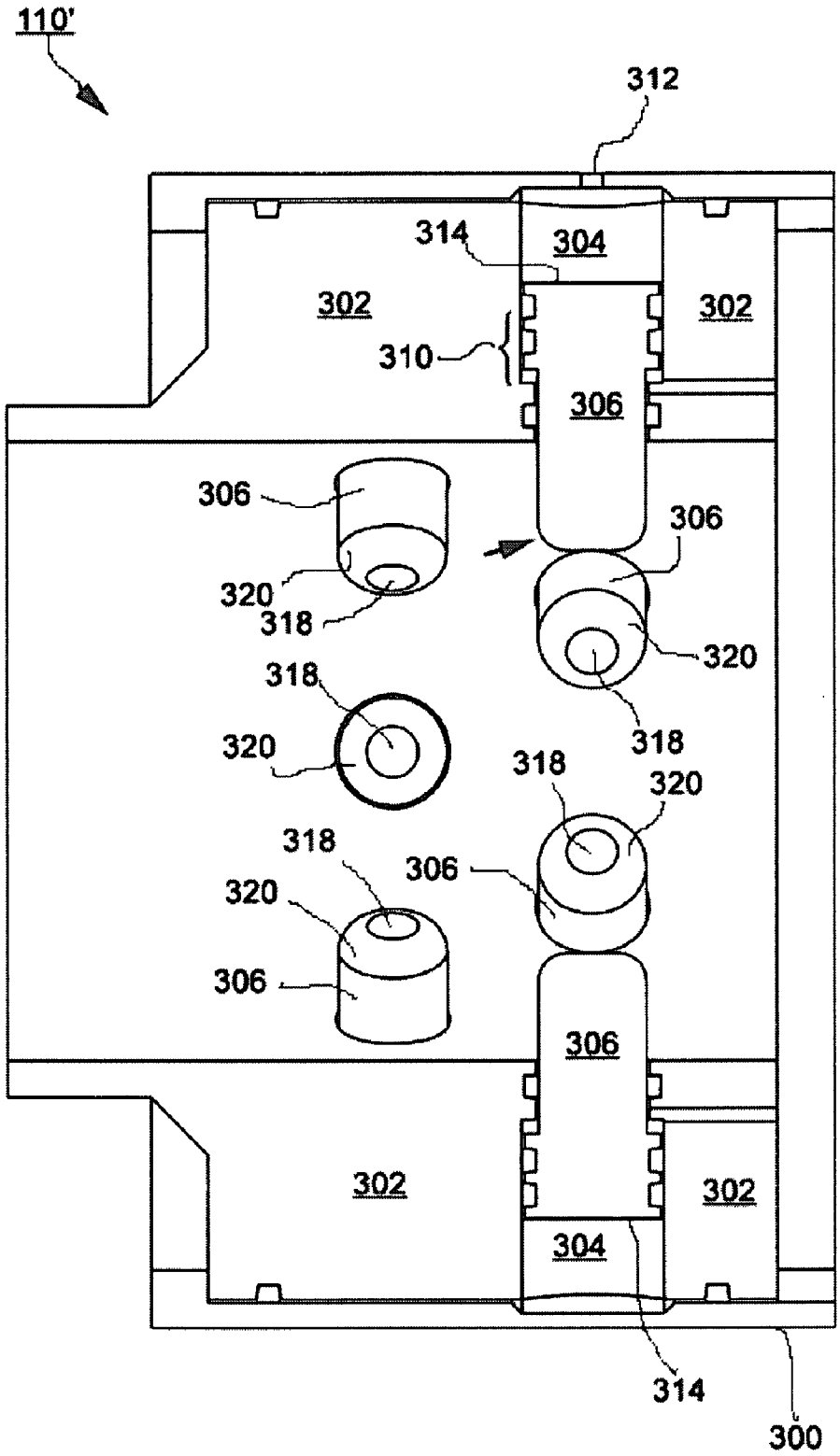
FIG. 19 is a side cross-sectional view of a make-up/torque module from FIG. 16 shown in a closed or engaged state.
Figure 20:
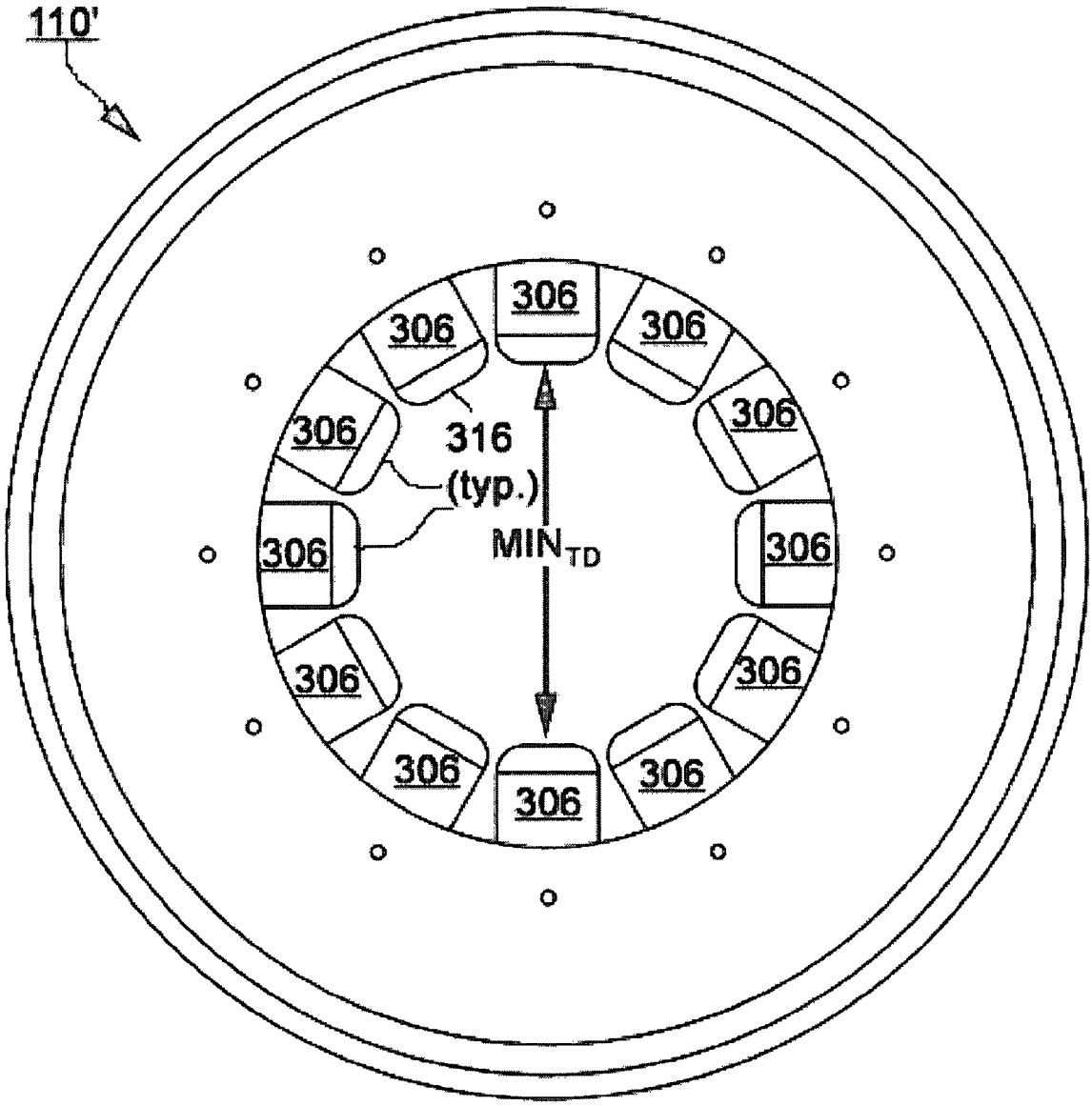
FIG. 20 is an end view of the make-up/torque module from FIG. 16 in a closed or engaged state.

FIG. 18 is a side cross-sectional view of make-up/torque module 110' showing tubular element 102 having been inserted therein. Furthermore, FIG. 18, as well as FIGS. 19 and 20, show make-up/torque module 110' with pistons 306 having been driven radially inward through application of hydraulic pressure via ports 312. As shown particularly in FIG. 18, actuation of pistons 306 to exert radially-inward force causes distal ends 316 of each piston 306 to be forcibly pressed against the outer wall 322 of a tubular 102 inserted into make-up/torque module 110'.

It is believed that the embodiment 110' of the present invention offers significant advantages over the prior art, as well as over the embodiment 110 disclosed hereinabove, principally because embodiment 110' is capable of engaging tubular sections such as tubular 102 of varying dimensions without the necessity of any replacement or reconfiguration. Specifically, a comparison of embodiment 110' as shown in FIGS. 17 and 20 (open and closed positions, respectively) shows that any tubular of outer diameter less than or equal to $MAX_{TD}$ or greater than or equal to $MIN_{TD}$ can be engaged by make-up torque module 110'. In one exemplary embodiment (not to be taken as limiting with respect to the scope of the invention, $MAX_{TD}$ and $MIN_{TD}$ are such that any tubular with outer diameter from $MIN_{TD}$=5½ to $MAX_{TD}$=7 inches can be engaged for the purposes of applying torque force to the tubular (such as for make-up or break-up of a casing string).

Those of ordinary skill in the art will appreciate that the amount of radially inward force exerted by pistons 306 may be of such magnitude as to cause a slight deformation of the outer wall of a tubular (not shown in the Figures). Distal faces 318 and contoured portions 320 of each piston thereby cooperate to ensure that make-up/torque module 110' can transfer the necessary torque force upon tubular 102 depending upon the particular application. Moreover, the amount of force exerted upon the outer wall 322 of tubular 102 can be controlled by varying the hydraulic pressure applied through ports 312.

From the foregoing detailed description, it should be apparent that systems and methods for manipulating tubular structures such as oil/gas well casing and the like has been disclosed. Although specific embodiments of the invention have been described herein, it is to be understood that this has been done solely for the purposes of illustrating various features and aspects of the invention, and is not intended to be limiting with respect to the scope of the invention, as defined in the claims. It is contemplated and to be understood that various substitutions, alterations, and/or modifications, including such implementation variants and options as may have been specifically noted or suggested herein, may be made to the disclosed embodiments of the invention without departing from the spirit or scope of the invention.

What is claimed is:

1. A tubular running tool comprising an elevation assembly integral and axially aligned with a make-up/torque assembly, wherein:

said elevation assembly comprises a lifting collet adapted to automatically engage a lifting collar on an end of a tubular structure, said lifting collar being engaged by said lifting collet when said tubular structure advances longitudinally into said running tool a predetermined longitudinal distance;

said make-up/torque assembly comprises at least one piston hydraulically actuable to advance radially inward relative to a longitudinal axis of said tool, causing said running tool to grasp said tubular structure with sufficient force as to permit said running tool to impart a torquing force upon said tubular structure; and wherein said at least one piston comprises a plurality of radially-oriented pistons disposed in radially-oriented piston cylinders formed in a body of said make-up/torque assembly.

2. A tubular running tool in accordance with claim 1, wherein said body of said make-up/torque assembly is surrounded by an outer cylindrical casing thereby defining a sealed compression volume behind said plurality of pistons.

3. A tubular running tool in accordance with claim 2, wherein said outer cylindrical casing includes a hydraulic port for creating hydraulic pressure in said compression volume, said hydraulic pressure tending to force said pistons radially inward relative to said longitudinal axis.

4. A tubular running tool in accordance with claim 3, further comprising a substantially cylindrical collet structure disposed in front of each of said pistons, such that radially inward advancement of said pistons exerts deformation pressure upon said collet structure.

5. A tubular running tool in accordance with claim 4, wherein said collet structure carries a plurality of compression slips on an inner diameter thereof, said compression slips being forced against an outer wall of a tubular structure inserted into said tool upon advancement of said pistons and resultant deformation of said collet structure.

6. A tubular running tool in accordance with claim 5, wherein said compression slips collectively create sufficient force against said outer wall of said inserted tubular that rotational force applied to said tool is transferred to said tubular, thereby causing rotation of said tubular structure.

7. A tubular running tool in accordance with claim 1, further comprising an internal valve assembly coaxial with said elevation assembly and said make-up/torque assembly, said valve assembly adapted to be received within the interior cylindrical volume of a tubular inserted into the tool.

8. A tubular running tool in accordance with claim 7, wherein said valve assembly comprises a ball valve assembly including a ball having a port extending through its center thereby defining a central axis of said ball, disposed between two substantially annular ball valve seats, contained within an outer valve assembly body.

9. A tubular running tool in accordance with claim 8, wherein said ball valve assembly is slidably and longitudinally movable from a first longitudinal position within said outer valve assembly body to a second longitudinal position within said outer valve assembly body.

10. A tubular running tool in accordance with claim 9, wherein when said ball valve assembly is in said first longitudinal position said central axis of said ball is coaxial with said central axis of said tool, thereby permitting fluid flow through said valve assembly.

11. A tubular running tool in accordance with claim 10, wherein when said ball valve assembly is in said second longitudinal position said central axis of said ball is perpendicular to said central axis of said tool, thereby preventing fluid flow through said valve assembly.

12. A tubular running tool in accordance with claim 3, wherein said plurality of pistons are actuable radially from fully outwardly retracted positions to fully inwardly extended positions in response to the creation of hydraulic pressure in said compression volume.

13. A tubular running tool in accordance with claim 12, wherein each of said plurality of pistons has a forward face adapted to frictionally engage an outer diameter of a tubular extending through said tool.

14. A tubular running tool in accordance with claim 13 wherein said pistons are capable of engaging tubing having an outer diameter varying between a predetermined minimum outer diameter and a predetermined maximum outer diameter.

15. A top drive drilling system, comprising:

a drilling rig supporting a top drive assembly at a desired height above said drilling rig floor, said top drive assembly comprising a drive motor having a rotating output shaft;

a tubular running tool comprising an elevation assembly integral and axially aligned with a make-up/torque assembly, said tubular running tool adapted for coupling to said drive motor output shaft, wherein:

said elevation assembly comprises a lifting collet adapted to automatically engage a lifting collar on an end of a tubular structure, said lifting collar being engaged by said lifting collet when said tubular structure advances longitudinally into said running tool a predetermined longitudinal distance;

said make-up/torque assembly comprises at least one piston hydraulically actuable to advance radially inward relative to a longitudinal axis of said tool, causing said running tool to grasp said tubular structure with sufficient force as to permit said running tool to impart a torquing force applied by said motor output shaft upon said tubular structure;

wherein said lifting collet is spring biased to an engaging position, such that engagement of said lifting collar is automatic upon advancement of said tubular into said tool; and wherein said at least one piston comprises a plurality of radially-oriented pistons disposed in radially-oriented piston cylinders formed in a body of said make-up/torque assembly.

16. A top drive drilling system in accordance with claim 15, wherein said body of said make-up/torque assembly is surrounded by an outer cylindrical casing thereby defining a sealed compression volume behind said plurality of pistons.

17. A top drive drilling system in accordance with claim 16, wherein said outer cylindrical casing includes a hydraulic port for creating hydraulic pressure in said compression volume, said hydraulic pressure tending to force said pistons radially inward relative to said longitudinal axis.

18. A top drive drilling system in accordance with claim 17, further comprising a substantially cylindrical collet structure disposed in front of each of said pistons, such that radially inward advancement of said pistons exerts deformation pressure upon said collet structure.

19. A top drive drilling system in accordance with claim 18, wherein said collect structure carries a plurality of compression slips on an inner diameter thereof, said compression slips being forced against-an outer wall of a tubular structure inserted into said tool upon advancement of said pistons and resultant deformation of said collet structure.

20. A top drive drilling system in accordance with claim 19, wherein said compression slips collectively create sufficient force against said outer wall of said inserted tubular that rotational force applied to said tool via said top drive output shaft is transferred to said tubular, thereby causing rotation of said tubular structure.

21. A top drive drilling system in accordance with claim 15, further comprising an internal valve assembly coaxial with said elevation assembly and said make-up/torque assembly, said valve assembly adapted to be received within the interior cylindrical volume of a tubular inserted into the tool.

22. A top drive drilling system in accordance with claim 21, wherein said valve assembly comprises a ball valve assembly including a ball having a port extending through its center thereby defining a central axis of said ball, disposed between two substantially annular ball valve seats, contained within an outer valve assembly body.

23. A top drive drilling system in accordance with claim 22, wherein said ball valve assembly is slidably and longitudinally movable from a first longitudinal position within said outer valve assembly body to a second longitudinal position within said outer valve assembly body.

24. A top drive drilling system in accordance with claim 23, wherein when said ball valve assembly is in said first longitudinal position said central axis of said ball is coaxial with said central axis of said tool, thereby permitting fluid flow through said valve assembly.

25. A top drive drilling system in accordance with claim 24, wherein when said ball valve assembly is in said second longitudinal position said central axis of said ball is perpendicular to said central axis of said tool, thereby preventing fluid flow through said valve assembly.

26. A top drive drilling system in accordance with claim 24, wherein said central axis of said ball automatically rotates from a parallel orientation with respect to said longitudinal axis to a parallel orientation with respect to said longitudinal axis as said valve assembly is moved from said first longitudinal position to said second longitudinal position.

27. A top drive drilling system in accordance with claim 26, further comprising a rack-and-pinion gear system for causing said ball to rotate in response to movement of said ball valve assembly longitudinally between said first longitudinal position and said second longitudinal position.

28. A top drive drilling system in accordance with claim 27, wherein said rack-and-pinion gear system comprises:

a pinion gear rigidly coupled to a side of said ball and having a toothed circumference substantially parallel to said central axis of said ball; and a substantially planar rack gear having teeth formed on an upper surface thereof, said rack gear being integral with or rigidly supported by said outer valve assembly body, said rack gear teeth being adapted to engage said teeth around the circumference of said pinion gear.

29. A tubular running tool in accordance with claim 15, wherein said plurality of pistons are actuable radially from fully outwardly retracted positions to fully inwardly extended positions in response to the creation of hydraulic pressure in said compression volume.

30. A tubular running tool in accordance with claim 29, wherein each of said plurality of pistons has a forward face adapted to frictionally engage an outer diameter of a tubular extending through said tool.

31. A tubular running tool in accordance with claim 30 wherein said pistons are capable of engaging tubing having an outer diameter varying between a predetermined minimum outer diameter and a predetermined maximum outer diameter.

32. A tubular running tool in accordance with claim 28, wherein said plurality of pistons are actuable radially from fully outwardly retracted positions to fully inwardly extended positions in response to the creation of hydraulic pressure in said compression volume.

33. A tubular running tool in accordance with claim 32, wherein each of said plurality of pistons has a forward face adapted to frictionally engage an outer diameter of a tubular extending through said tool.

34. A tubular running tool in accordance with claim 33 wherein said pistons are capable of engaging tubing having an outer diameter varying between a predetermined minimum outer diameter and a predetermined maximum outer diameter.

* * * * *